US007051482B2

(12) United States Patent
MacDonald et al.

(10) Patent No.: US 7,051,482 B2
(45) **Date of Patent: *May 30, 2006**

(54) PANEL SYSTEM

(75) Inventors: Douglas B. MacDonald, Caledonia, MI (US); Steven E. Sanders, Ann Arbor, MI (US); Mark T. Slager, Caledonia, MI (US); Dean K. Hubbard, Bryon Center, MI (US); Roy W. Fink, Portage, MI (US); Steven J. Throndset, Kentwood, MI (US); David J. Battey, Kentwood, MI (US); Robert E. Jeffers, Ada, MI (US); Allen C. Hager, Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 78 days.

This patent is subject to a terminal disclaimer.

(21) Appl. No.: 10/770,368

(22) Filed: Feb. 2, 2004

(65) Prior Publication Data

US 2004/0154756 A1 Aug. 12, 2004

Related U.S. Application Data

(63) Continuation of application No. 10/077,553, filed on Feb. 15, 2002, now Pat. No. 6,684,929.

(51) Int. Cl.
*E04H 1/00* (2006.01)

(52) U.S. Cl. ..... 52/239; 160/135

(58) Field of Classification Search ..... 160/135, 160/385, 354, 351, 352; 52/239, 36.1, 468, 52/718.04, 80.11, 36.6

See application file for complete search history.

(56) References Cited

U.S. PATENT DOCUMENTS 2,262,426 A 11/1941 Hall (Continued)

OTHER PUBLICATIONS

Exhibit A is promotional material describing SMED International Office Furniture published at least as early as Feb. 14, 2001.

*Primary Examiner*—David Purol
(74) *Attorney, Agent, or Firm*—Price, Heneveld, Cooper, DeWitt & Litton, LLP

(57) ABSTRACT

An office panel partition includes a panel frame having at least two uprights and a horizontal structural member rigidly interconnecting the uprights. The panel frame has a first side and a second opposite side, and the panel frame defines at least four apertures on the first side thereof. The partition also includes a cover member having a major planar surface defining an exterior surface of the partition. The cover member includes at least four projections that are removably insertable into the at least four apertures to removably secure the cover member to the frame. The apertures are arranged in at least two vertically spaced horizontal rows and at least two horizontally spaced vertical columns. The apertures in a first one of the columns have different horizontal dimensions than those of the apertures located in the other of the columns. Each of the projections has a range of lateral positions when inserted into a respective one of the apertures. The range of lateral positions provided by the apertures in the first one of the columns is less than the range of lateral positions provided by the apertures in the other row of the columns. The apertures located in a first one of the rows has vertical dimensions that are different than those located in the other of the rows. The range of vertical positions provided by the apertures in the first one of the rows is less than the range of vertical positions provided by the apertures in the other of the rows.

98 Claims, 31 Drawing Sheets

U.S. PATENT DOCUMENTS 2,336,870 A 12/1943 La Grotta
3,037,593 A 6/1962 Webster
3,180,459 A 4/1965 Liskey, Jr.
3,312,025 A 4/1967 Deakins
3,327,440 A 6/1967 Watkins
3,462,892 A 8/1969 Meyer
3,517,467 A 6/1970 Propst et al.
3,589,755 A 6/1971 King
3,601,432 A 8/1971 Fenwick et al.
3,697,034 A 10/1972 Shell
3,849,962 A 11/1974 Albinson et al.
4,104,838 A 8/1978 Hage et al.
4,222,542 A 9/1980 Wilson et al.
4,391,073 A 7/1983 Mollenkopf et al.
4,423,573 A 1/1984 Omholt et al.
4,434,596 A 3/1984 McAteer et al.
4,531,564 A 7/1985 Hanna
4,535,577 A 8/1985 Tenser et al.
4,545,168 A 10/1985 Dalton, Jr.
4,571,907 A 2/1986 DeFouw et al.
4,601,137 A 7/1986 Bates
4,611,448 A 9/1986 De Long
4,631,881 A 12/1986 Charman
4,685,255 A 8/1987 Kelley
4,704,835 A 11/1987 Jordan
4,712,336 A 12/1987 Backer
4,716,692 A 1/1988 Harper et al.
RE32,890 E 3/1989 DeFouw et al.
4,876,835 A 10/1989 Kelley et al.
4,881,349 A 11/1989 Brown et al.
4,907,384 A 3/1990 Underwood
4,914,873 A 4/1990 Newhouse
4,914,878 A 4/1990 Tamaki et al.
4,941,873 A 7/1990 Fischer
4,942,805 A 7/1990 Hellwig et al.
4,947,601 A 8/1990 McGuire
4,976,080 A 12/1990 Zegel et al.
4,991,365 A 2/1991 Jackson
5,003,740 A 4/1991 Dull et al.
5,013,112 A 5/1991 Hellwig
5,038,539 A 8/1991 Kelley et al.
5,054,255 A 10/1991 Maninfior
5,058,347 A 10/1991 Schuelke et al.
5,063,715 A 11/1991 Goodman
5,081,808 A 1/1992 Bastian et al.
5,125,201 A 6/1992 Pieters et al.
5,206,972 A 5/1993 Nudelmont et al.
5,214,890 A 6/1993 Levitan et al.
5,219,406 A 6/1993 Raz
5,251,996 A 10/1993 Hiller et al.
5,277,005 A 1/1994 Hellwig et al.
5,287,666 A 2/1994 Frascaroli et al.
5,305,567 A 4/1994 Wittler
5,313,751 A 5/1994 Wittler
5,347,778 A 9/1994 Bray
5,406,760 A 4/1995 Edwards
5,430,984 A 7/1995 Young et al.
5,479,747 A 1/1996 Wu
5,490,357 A 2/1996 Lin
5,502,930 A 4/1996 Burkette et al.
5,537,290 A 7/1996 Brown et al.
5,555,689 A 9/1996 Gilmore
5,579,621 A 12/1996 Fang
5,606,836 A 3/1997 Insalaco et al.
5,638,650 A 6/1997 Edwards
5,642,593 A 7/1997 Shieh
5,715,633 A 2/1998 Raz et al.
5,737,887 A 4/1998 Smeenge
5,802,789 A 9/1998 Goodman et al.
5,806,258 A 9/1998 Miedema et al.
5,813,178 A 9/1998 Edwards
5,839,240 A 11/1998 Elsholz et al.
5,852,904 A 12/1998 Yu et al.
5,867,955 A 2/1999 Russell
5,875,594 A 3/1999 Hellwig et al.
5,875,596 A 3/1999 Muller
5,881,500 A 3/1999 Latino et al.
5,899,025 A 5/1999 Casey et al.
5,899,035 A 5/1999 Waalkes et al.
5,907,937 A 6/1999 Loftus et al.
5,930,963 A 8/1999 Nichols
5,943,834 A 8/1999 Jeffers et al.
6,000,179 A 12/1999 Musculus et al.
6,000,180 A 12/1999 Goodman et al.
6,009,676 A 1/2000 Feldpausch et al.
6,015,195 A 1/2000 Anderson et al.
6,017,228 A 1/2000 Verbeek et al.
6,021,613 A 2/2000 Reuter et al.
6,023,893 A 2/2000 Tanaka
6,047,509 A 4/2000 Savoie
6,052,958 A 4/2000 Miedema et al.
6,079,173 A 6/2000 Waalkes et al.
6,088,980 A 7/2000 Gulliver
6,098,358 A 8/2000 Waalkes et al.
6,105,322 A 8/2000 Chang
6,112,472 A 9/2000 Van Dyk et al.
6,112,485 A 9/2000 Beyer et al.
6,115,977 A 9/2000 Hornberger et al.
6,131,347 A 10/2000 Hornberger et al.
6,138,968 A 10/2000 Svantesson et al.
6,148,567 A 11/2000 DeRuiter et al.
6,202,301 B1 3/2001 Kawaguchi
6,202,381 B1 3/2001 Dame et al.
6,223,485 B1 5/2001 Beck et al.
6,226,849 B1 5/2001 Beck et al.
6,230,445 B1 5/2001 Arko et al.
6,230,459 B1 5/2001 Jeffers et al.
6,240,687 B1 6/2001 Chong
6,241,109 B1 6/2001 Kautz et al.
6,244,002 B1 6/2001 Martin
6,250,032 B1 6/2001 Davis et al.
6,253,509 B1 7/2001 Hellwig et al.
6,256,941 B1 7/2001 Yu et al.
6,260,324 B1 7/2001 Miedema et al.
6,272,803 B1 8/2001 Stachowiak et al.
6,276,102 B1 8/2001 Shipman et al.
6,295,764 B1 10/2001 Berridge et al.
6,301,847 B1 10/2001 Beck et al.
6,314,687 B1 11/2001 Schondelmayer et al.
6,339,907 B1 1/2002 Dame et al.
6,339,909 B1 1/2002 Brunnhofer et al.
6,341,457 B1 1/2002 Aerts et al.
6,684,929 B1 * 2/2004 Slager et al. ..... 160/135

* cited by examiner

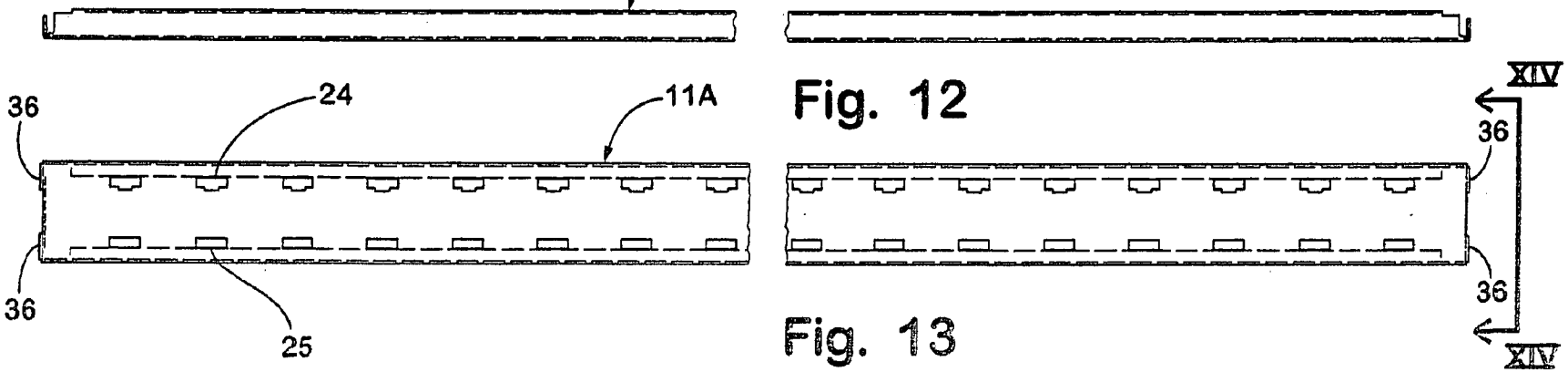
Fig. 12
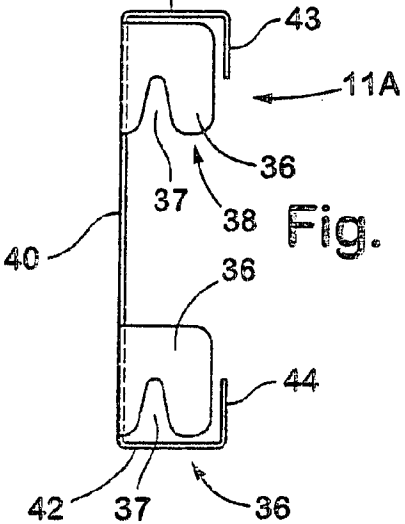
Fig. 13
Fig. 14

PANEL SYSTEM

This application is a continuation of Ser. No. 10/077,553 filed Feb. 15, 2002 now U.S. Pat. No. 6,684,929.

BACKGROUND OF THE INVENTION

The present invention relates to open office plans and the like.

The efficient use of building floor space is an ever-growing concern, particularly as building costs continue to escalate. Open office plans have been developed to reduce overall officing costs, and generally incorporate large, open floor spaces in buildings that are equipped with modular furniture systems which are readily reconfigurable to accommodate the ever-changing needs of a specific user, as well as the divergent requirements of different tenants. One arrangement commonly used for furnishing open plans includes movable partition panels are detachably interconnected to partition off the open spaces into individual workstation and/or offices. Such partition panels are configured to receive hang-on furniture units, such as worksurfaces, overhead cabinets, shelves, etc., and are generally known in the office furniture industry as "systems furniture". Another arrangement for dividing and/or partitioning open plans includes modular furniture arrangements, in which a plurality of differently shaped, freestanding furniture units are positioned in a side-by-side relationship, with upstanding privacy screens attached to at least some of the furniture units to create individual, distinct workstations and/or offices. Both of these types of modular furniture systems, as well as others, have been widely received due largely to their ability to be readily reconfigured and/or moved to a new site, since they are not part of a permanent leasehold improvement.

At present, some types of furniture systems utilize vertical rows of slots to support hang-on furniture units. Also, systems have been developed that utilize horizontal rows of slots for supporting hang-on furniture units such as storage units, worksurfaces and the like. Existing furniture systems commonly include cover panels that are attached to a partition frame to close off the frame and provide visual and audio privacy for the worker. However, existing furniture systems may not provide sufficient flexibility to permit the location of the hang-on furniture units to be readily adjusted. Furthermore, positioning of the cover panels on existing systems may be problematic.

SUMMARY OF THE INVENTION

One aspect of the present invention is to provide an office panel partition including a panel frame having at least two generally vertical uprights and a horizontal structural member rigidly interconnecting the vertical uprights. The panel frame has a first side and a second opposite side, and the panel frame defines at least four apertures on the first side thereof. The partition also includes a cover member having a major planar surface defining an exterior surface of the partition. The cover member includes at least four projections extending therefrom, each of the four projections having a common projecting configuration. The at least four projections are removably insertable into the at least four apertures. Insertion of the projections in the apertures removably secures the cover member to the frame. The apertures are arranged in at least two vertically spaced horizontal rows and at least two horizontally spaced vertical columns. The apertures in a first one of the columns have horizontal dimensions which differ from horizontal dimensions of the apertures located in the other of the columns. Each of the projections has the common projection configuration having a range of lateral positions when inserted into a respective one of the apertures. The range of lateral positions provided by the apertures in the first one of the columns is less than the range of lateral positions provided by the apertures in the other row of the columns. The apertures located in a first one of the rows has vertical dimensions which differ from vertical dimensions of the aperture located in the other of the rows. Each of the projections has a common projecting configuration having a range of vertical positions when inserted into a respective one of the apertures. The range of vertical positions provided by the apertures in the first one of the rows being less than the range of vertical positions provided by the apertures in the other of the rows.

Another aspect of the present invention is a partition panel for dividing floor space including a frame having a pair of horizontally spaced apart vertical frame members and a pair of vertically spaced apart horizontal frame members extending between and rigidly interconnecting the vertical frame members to form a rigid frame having generally vertical opposed side faces. An intermediate horizontal beam is positioned between the horizontal frame members and extends between the vertical frame members. The intermediate beam defines a side face having a plurality of apertures therethrough forming a horizontal row of apertures. The partition panel further includes at least one hang-on furniture unit having at least one connector extending into a selected one of the apertures to support the hang-on furniture unit. A cover panel is secured to the frame and covers at least a portion of a selected one of the side faces.

Yet another aspect of the present invention is a partition panel including a rigid partition frame defining generally vertical opposed side faces. The partition frame includes at least four apertures, each defining a horizontal dimension and a vertical dimension. A first one of the apertures has a first vertical dimension and a first horizontal dimension. A second one of the apertures has a vertical dimension that is approximately the same as the first vertical dimension, and a horizontal dimension that is greater than the first horizontal dimension. A third one of the apertures has a vertical dimension that is greater than the first vertical dimension, and a horizontal dimension that is approximately the same as the first horizontal dimension. A fourth one of the apertures has a vertical dimension greater than the first vertical dimension, and a horizontal dimension greater than the first horizontal dimension. The partition panel further includes a cover panel having connectors received in each of the apertures to support and position the cover panel on the partition frame.

Yet another aspect of the present invention is a partition panel for dividing floor space including a frame having a pair of horizontally spaced apart vertical frame members and a pair of vertically spaced apart horizontal frame members extending between and rigidly interconnecting the vertical frame members to form a rigid frame having generally vertical opposed side faces. An intermediate horizontal beam is positioned between the horizontal frame members and extends between the vertical frame members. The intermediate beam defines a side face having a plurality of apertures therethrough forming a horizontal row. The partition panel includes at least one hang-on furniture unit having at least one connector extending into a selected one of the apertures to support the hang-on furniture unit. The partition panel further includes a cover panel secured to the frame and covering at least a portion of a selected one of the side faces.

Yet another aspect of the present invention is a partition panel including a pair of horizontally spaced apart upright frame members, and vertically spaced apart upper and lower horizontal frame members extending between the upright frame members and rigidly interconnecting the upright frame members to form a rigid partition frame adapted to be abuttingly supported in an upright position freestanding on a floor surface. The partition frame defines an open interior space. A pair of side-by-side horizontal beams extend between the upright frame members, each horizontal beam having opposite ends connected to the upright frame members. Each horizontal beam includes a horizontal row of apertures and first connectors. The horizontal beams are positioned at a location that is between the upper and lower horizontal frame members. The partition panel further includes a cover panel secured to the partition frame and closing off at least a portion of the open interior space. The cover panel includes second connectors engaging the first connectors to secure the cover panel to a selected one of the horizontal beams.

Yet another aspect of the present invention is a partition panel including a pair of horizontally spaced-apart upright frame members, and vertically spaced apart upper and lower horizontal frame members extending between the upright frame members and rigidly interconnecting the upright frame members to form a rigid partition frame adapted to be abuttingly supported in an upright position freestanding on a floor surface. The partition frame defines an open interior space. The partition panel includes a pair of side-by-side horizontal beams extending between the upright frame members at a location between the upper and lower horizontal frame members. Each horizontal beam has hooks on opposite ends connected to the upright frame members, and also includes first connectors. A cover panel is secured to the partition frame and closing off at least a portion of the open interior space.

These and other features, advantages, and objects of the present invention will be further understood and appreciated by those skilled in the art by reference to the following written specification, claims, and appended drawings.

BRIEF DESCRIPTION OF THE DRAWINGS

FIG. 2;

FIG. 2;

FIG. 3C;

FIG. 3D;

FIG. 12 is a fragmentary top plan view of a light duty intermediate horizontal beam;

FIG. 13 is a fragmentary, front elevational view of the light duty intermediate horizontal beam of FIG. 12;

FIG. 14 is an end view of the light duty intermediate horizontal beam of FIG. 13 taken along the line XIV—XIV;

FIG. 23C;

FIG. 29;

FIG. 45.

DETAILED DESCRIPTION OF PREFERRED EMBODIMENT

The present application is related to co-pending patent application Ser. No. 10/076,709 (now U.S. Pat. No. 6,851,226) entitled PARTITION PANEL WITH MODULAR APPLIANCE MOUNTING ARRANGEMENT, filed on even date herewith, the entire contents of which are hereby incorporated herein by reference.

Figure 1A:
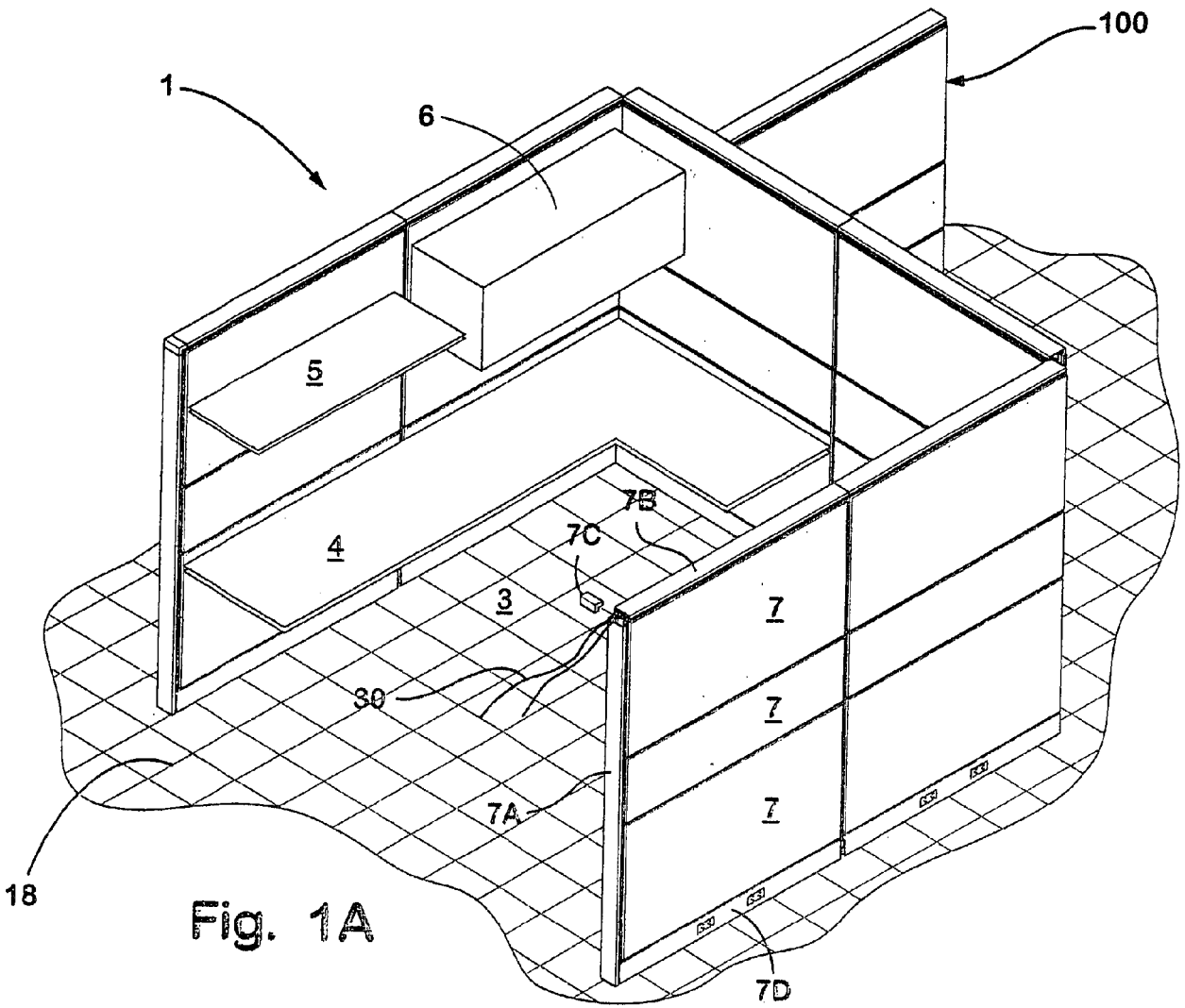
FIG. 1A is a perspective view of a partition panel system embodying the present invention.

For purposes of description herein, the terms "upper," "lower," "right," "left," "rear," "front," "vertical," "horizontal," and derivatives thereof shall relate to the invention as oriented in FIG. 1A. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1B:
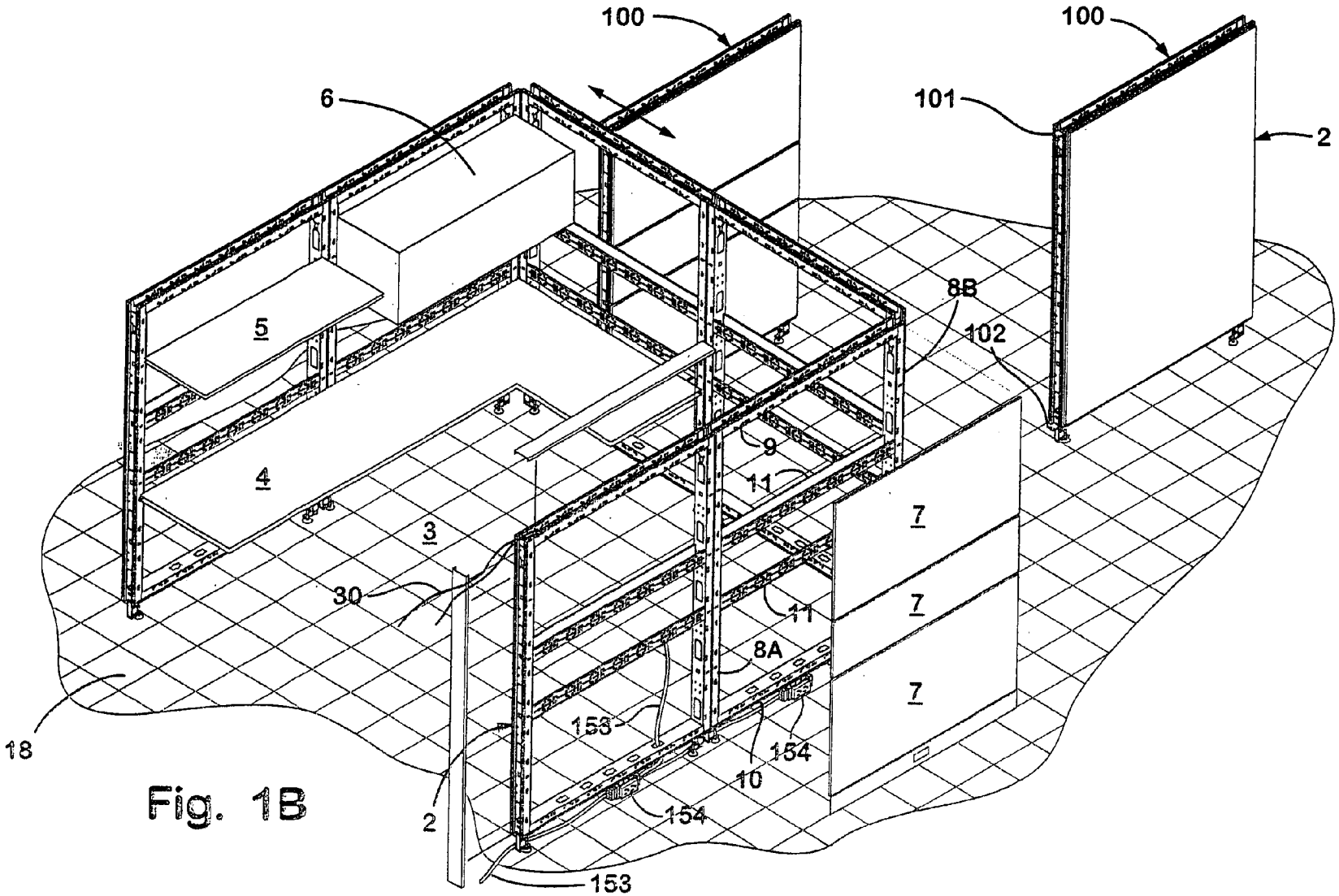
FIG. 1B is a partially exploded, perspective view of the partition panel system of FIG. 1A.

The reference numeral 1 (FIGS. 1A and 1B) generally designates a partition system 1 embodying the present invention, which is particularly designed for use in open office plans, and other similar settings and environments. Partition system 1 includes a plurality of partition frames 2 that are rigidly interconnected to define a workspace 3 that may include various hang-on furniture units such as a worksurface 4, shelf 5, or storage unit 6. As described in more detail below, a plurality of cover panels or "skins" 7 may be connected to the partition frames 2 to close off the partition frame 2 and provide privacy for a user. Trim members 7A, 7B and 7C cover the edge portions of the frames 2, and base trim 7D closes off the lower portion of the partitions. Lower frame members 10 are spaced above floor surface 18 to define a lower horizontal raceway 152. Power lines 153 and power receptacles 154 in raceway 152 provide power to the partition system.

Figures 2, 3, 4, 5, 7, 8, 9, 10:
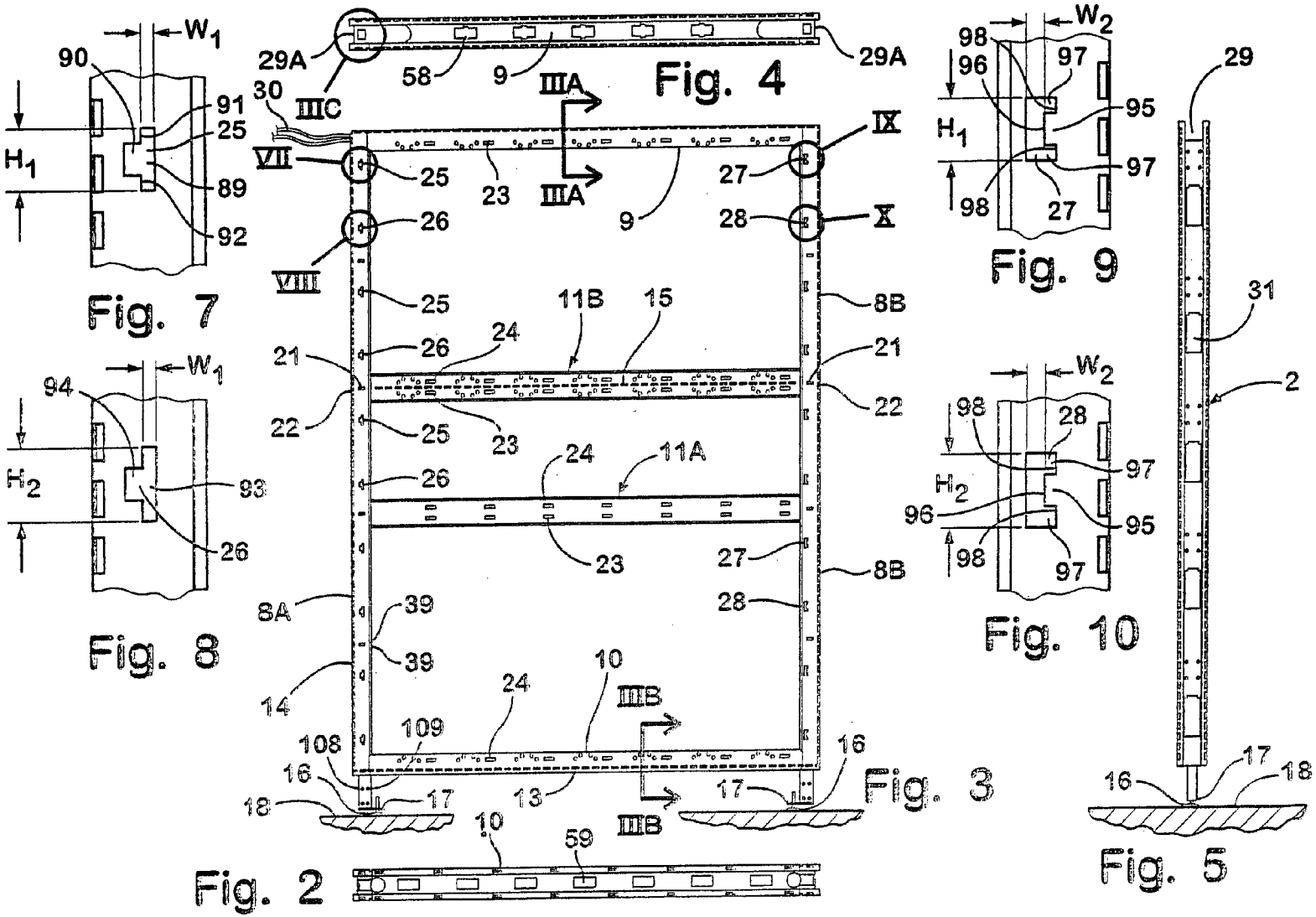
FIG. 2 is a bottom view of a partition frame.
FIG. 3 is a front elevational view of the panel frame of FIG. 2.
FIG. 4 is a top plan view of the panel frame of FIG. 3.
FIG. 5 is a right elevational view of the panel frame of FIG. 3.
FIG. 7 is an enlarged view of an aperture that receives a mounting clip to support a cover panel.
FIG. 8 is an enlarged view of an aperture that receives a mounting clip to support a cover panel.
FIG. 9 is an enlarged view of an aperture that receives a mounting clip to support a cover panel.
FIG. 10 is an enlarged view of an aperture that receives a mounting clip to support a cover panel.

With further reference to FIG. 3, partition frame 2 includes a pair of upright frame members 8A, 8B, and upper frame member 9 and lower frame 10. The horizontal frame members 9 and 10 extend between the upright frame members, and rigidly interconnect the vertical frame members 8A and 8B to form the partition frame 2. Intermediate beams 11A and 11B are releasably interconnected with the vertical frame members 8A and 8B, and can be vertically repositioned within the interior of partition frame 2. As discussed in more detail below, beam 11A is a "light duty" beam that includes openings 23 and 24 for attachment of a cover panel 7, but does not include slots 15 for supporting hang-on furniture units. As also discussed in more detail below, beam 11B is a structural beam, and includes openings 23 and 24 for attachment of cover panels 7, and also includes a horizontal row of slots 15 for supporting hang-on furniture units such as a worksurface 4, shelf 5, or storage unit 6. The upper horizontal frame member 9 includes an upper horizontal row of slots 12, and lower horizontal frame member 10 includes a lower horizontal row of slots 13. The vertical frame members 8A and 8B each include a vertical row of slots 14. The horizontal rows of slots 12, 13 may also be utilized to support hang-on furniture units such as the shelf 5 and storage unit 6 illustrated in FIG. 1. The vertical rows of slots 14 in vertical frame members 8 may also be utilized to support hang-on furniture items such as the worksurface 4 illustrated in FIG. 1. The frame 2 includes glides 16 that threadably engage feet 17 to provide height adjustment for the partition frame 2 to account for irregularities in a floor surface 18. Vertical frame members 8A and 8B include upper openings 19 (see also FIG. 6) and 20 that are aligned with the upper horizontal row of slots 12 to provide a continuous row of slots 12 across the vertical frame members 8. Similarly, vertical frame members 8A and 8B include openings 21 and 22 at a plurality of vertically spaced apart locations to align with the intermediate beam 11 and provide a continuous horizontal row of slots 15.

Figure 6:
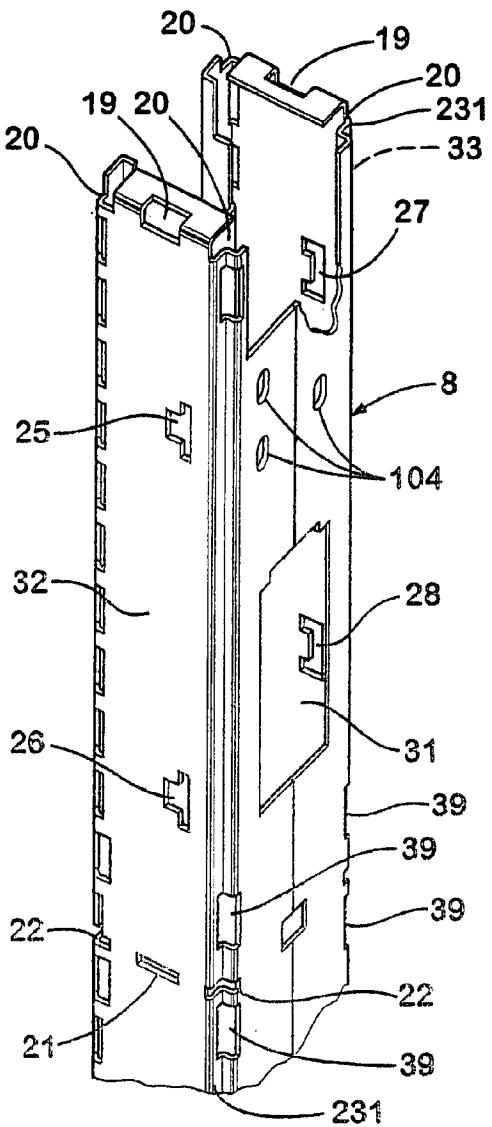
FIG. 6 is a fragmentary perspective view of a vertical frame member.

As described in more detail below, upper horizontal frame member 9 includes a plurality of openings 23 for securing cover panel 7, and lower horizontal frame member 10 includes openings 24 that are also utilized to secure the cover panel 7. As also described in more detail below, "left" vertical frame members 8A include upper left openings 25 and lower left openings 26 that are also utilized to secure the cover panels 7 to the partition frame 2. The "right" vertical frame member 8B includes an upper right opening 27 and a lower right opening 28, each of which are also utilized to support cover panels 7. Upper horizontal frame member 9 includes an upwardly opening U-shaped channel 29 to permit lay-in of utility lines such as communication lines 30 along the upper edge of the partition. Similarly, vertical side frame members 8 include vertical outwardly opening channels 29A (FIG. 4) to permit vertical routing of utility lines along the vertical side edges of the frame 2. Upper horizontal frame member 9 includes openings 58 to permit routing of utility lines through the frame member 9, and lower horizontal frame member 10 includes openings 59 (FIG. 2) therethrough to permit pass through of utility lines through the lower frame member 10. With further reference to FIG. 6, vertical frame members 8A and 8B also include a plurality of large apertures 31 to permit pass-through of wiring or other utility lines through the vertical frame members 8A and 8B. Each vertical frame member 8A, 8B includes a plurality of openings 25 and 26 in a first side face 32, and a plurality of openings 27 and 28 in a second, opposite side face 33. Accordingly, the vertical frame member 8 can be utilized as either a "left hand" vertical frame member 8A (FIG. 3), or as a "right hand" vertical frame member 8B, depending upon the orientation of the vertical frame member 8.

Figure 3A:
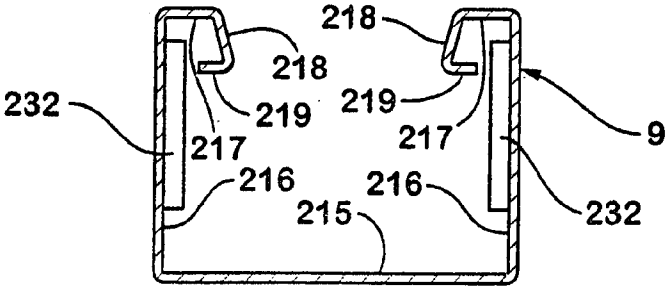
FIG. 3A is a cross-sectional view taken along the line IIIA—IIIA.
Figure 3B:
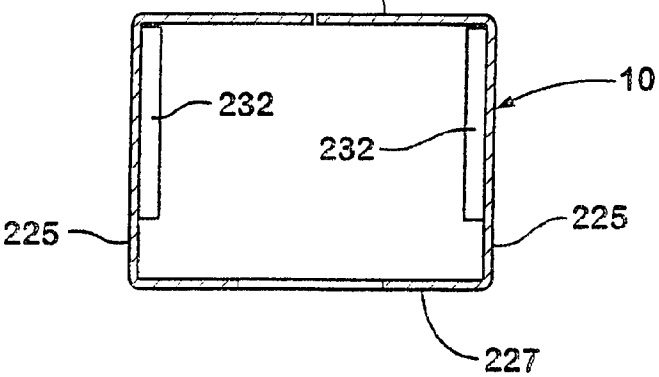
FIG. 3B is a cross-sectional view taken along the line IIIB—IIIB.

With further reference to FIG. 3A, cross member 9 includes a lower horizontal web 215 and vertical side webs 216 forming a generally U-shaped cross section. A horizontal portion 217 extends inwardly from the vertical side webs 216, and an inwardly angled portion 218 extends downwardly from the horizontal portion 217. An edge portion 219 extends horizontally from the angled portion 218. As described in detail below, lower horizontal frame member 9 and upper horizontal frame member 10 each include angled flanges 232 that facilitate welding of the opposite end portions of the frame members 9 and 10 to the vertical frame members 8A and 8B.

Figure 3C:
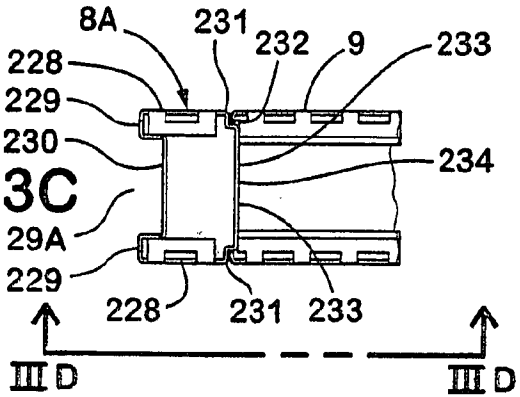
FIG. 3C is a partially fragmentary, cross-sectional view of the partition frame of FIG. 4.
Figure 3D:
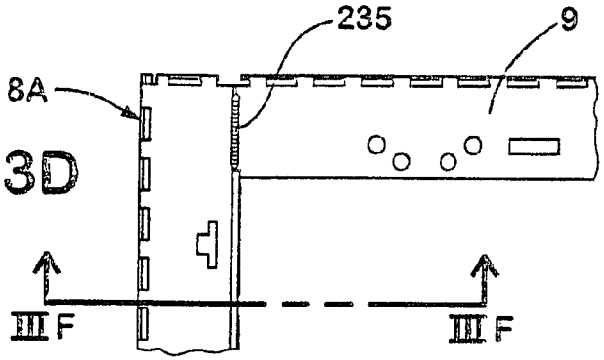
FIG. 3D is a partially fragmentary view taken along the line IIID—IIID.
Figure 3E:
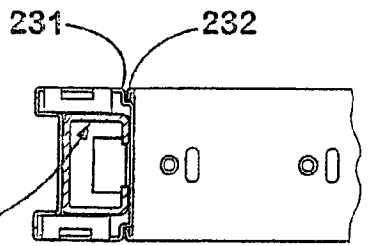
FIG. 3F is a partially fragmentary, cross-sectional view taken along the line IIIF—IIIF.

With further reference to FIG. 3C, vertical frame member 8A has a generally tubular cross-sectional shape including vertically extending outer webs 228, edge web portions 229, and offset edge web portion 230. Inwardly extending vertical web portions 233 extend towards one another and fit closely together at seam 234. A vertically extending V-groove 231 is formed at the intersection between the vertically extending web portions 228 and 233. When assembled, the angled webs 232 of horizontal frame members 9 and 10 are received in the vertically extending V-grooves 231. With further reference to FIG. 3D, a bead of weld material 235 rigidly interconnects the vertical frame member 8A with the horizontal frame members 9 and 10. The V-groove 231 and angled flanges 232 permit a flat surface, such that the weld material 235 does not protrude outwardly causing unsightly appearance and/or interfering with the mounting of cover panels 7, or other components. Preferably, each of the frame members 8A, 9, and 10 are roll-formed, thereby providing a cost-effective yet rigid and durable construction. With further reference to FIG. 3F, a corner bracket member 193 may be received within the vertical upright 8A, and is welded to the vertical uprights 8A and upper horizontal frame member 9 to strengthen the upper corners of the frame 2. The corner bracket 193 is described in more detail below in connection with FIG. 44.

Figure 11:
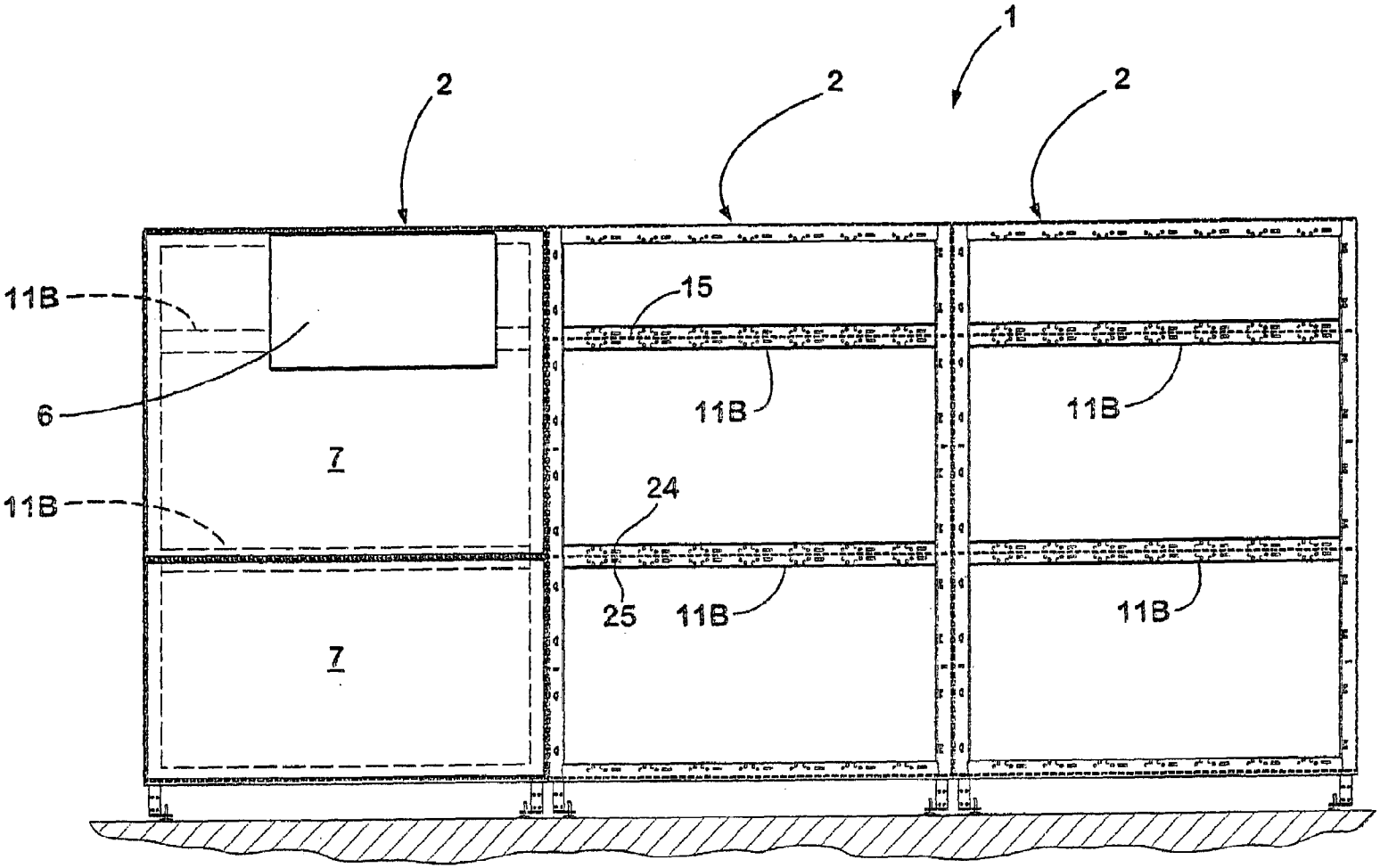
FIG. 11 is a plan view of a partition system embodying the present invention, illustrating the intermediate horizontal beams, cover panels, and hang-on furniture units.

With further reference to FIG. 11, a plurality of structural intermediate beams 11B may be mounted in the partition frame 2, thus providing a continuous row of slots 15 extending across the adjacent partition frames 2. This arrangement permits continuous horizontal adjustment of a hang-on furniture unit such as storage unit 6. Due to the openings 21 and 22 in the vertical frame members 8, the storage unit 6 can be positioned at any horizontal location along the adjacent frames 2, and may straddle a pair of adjacent uprights 8 if required for a particular application.

With reference to FIGS. 12–14, light duty beam 11A includes a plurality of openings 23 and 24 for mounting cover panels 7. However, the beam 11A does not include a horizontal row of slots 15 for supporting hang-on furniture units such as storage unit 6. Thus, the beam 11A is utilized for applications wherein hang-on furniture units are not needed at a specific location, but segmented cover panels 7 are desired. Beam 11A includes a pair of tabs 36 at each end, each of which includes a tapered slot 37 forming a hook 38. Each vertical frame member 8A and 8B (FIG. 6) includes pairs of openings 39 (FIGS. 17A and 17B) located generally at the same heights as openings 21 and 22. Beam 11A is installed by inserting hooks 38 into openings 39 at the desired height. Each vertical upright 8A and 8B includes pairs of openings 39 adjacent the first side face 32, and another pair of openings 39 adjacent the second side face 33, such that a pair of beams 11A can be mounted at the same height in a back to back manner. Alternately, a single beam 11A can be mounted on one side of the vertical frame member 8 if segmented cover panels 7 are only being mounted on one side of the partition frame 2. Beam 11A includes a vertical web 40 and an upper horizontal web 41 extending from the vertical web 40 and terminating in a downwardly extending flange 43. Similarly, lower horizontal web 42 extends from the vertical web 40 and terminates in upwardly extending flange 44.

Figure 15:
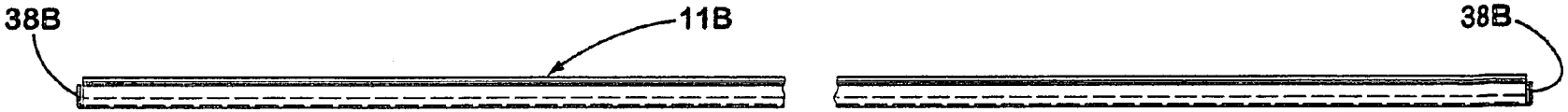
FIG. 15 is a fragmentary, top plan view of a structural intermediate horizontal beam.
Figure 16:
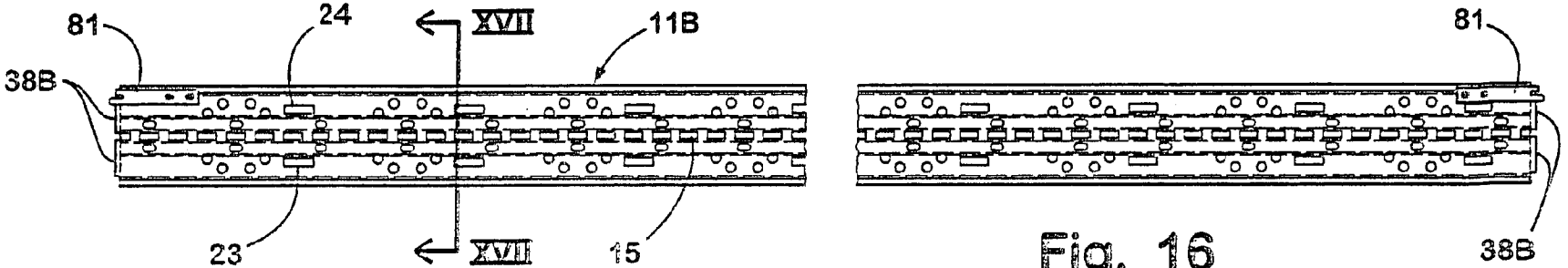
FIG. 16 is a fragmentary, front elevational view of the structural intermediate horizontal beam of FIG. 15.
Figure 17:
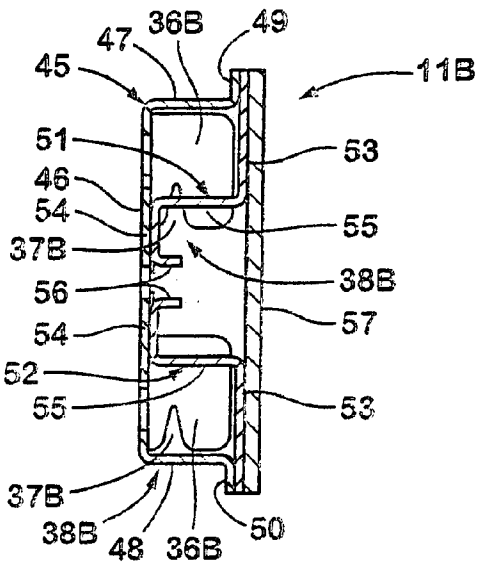
FIG. 17 is a cross-sectional view of the structural intermediate horizontal beam of FIG. 16 taken along the line XVII—XVII.
Figure 17C:
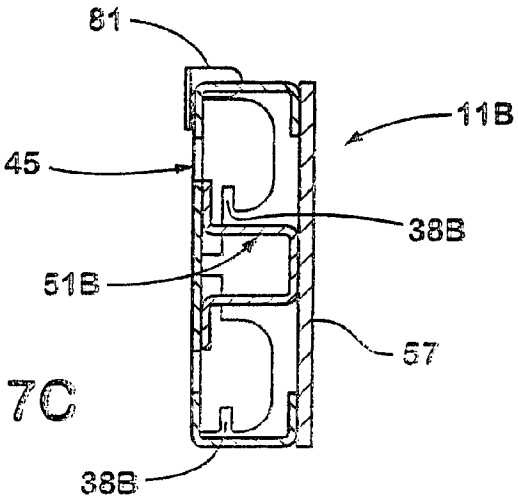
FIG. 17C is a cross-sectional view of an alternate embodiment of the structural intermediate horizontal beam of FIG. 17.

A structural intermediate beam 11B (FIGS. 15–17) includes tabs 36B with tapered slots 37B forming hooks 38B that are received in openings 39 of vertical frame member 8 in substantially the same manner described above in connection with hooks 38 of intermediate beam 11A. Intermediate beam 11B includes a first member 45 having a vertical web 46, upper web 47 terminating in upwardly extending flange 49. Similarly, lower web 48 of first member 45 terminates in a downwardly extending flange 50. A first inner reinforcing member 51 includes a first vertical web 53, and a second vertical web 54 that are interconnected by a horizontal web 55. An inner flange 56 extends inwardly from the second vertical web 54. A second inner reinforcing member 52 is a mirror image of the first inner reinforcing member 51. A back plate 57 is secured to the first and second inner reinforcing members 51 and 52 by welding or other suitable arrangement, and the first member 45 is similarly secured to the first and second inner reinforcing members 51 and 52. The combination of the first member 54, first and second reinforcing members 51 and 52, and back plate 57 together provide substantial structural strength, such that furniture units may be supported on the intermediate beam 11B by inserting the hooks (not shown) of the hang-on furniture unit into the horizontal row of slots 15. One example of such a hang-on furniture unit that mounts to a horizontal row of slots is the Pathways® Segment® storage bin that is manufactured by Steelcase, Inc. of Grand Rapids, Mich. The structural beam 11B can be selectively positioned on the partition frame 2 at a selected height, and the hang-on furniture unit such as storage unit 6 may be horizontally positioned at a desired location along the horizontal row of slots 15. Thus, the hang-on furniture unit can be positioned at a desired location and adjusted both vertically and horizontally.

In an alternate embodiment, beam 11B includes a single hat-shaped elongated reinforcing member that is welded or otherwise secured to the first member 45 and/or backing plate 57.

Figure 17B:
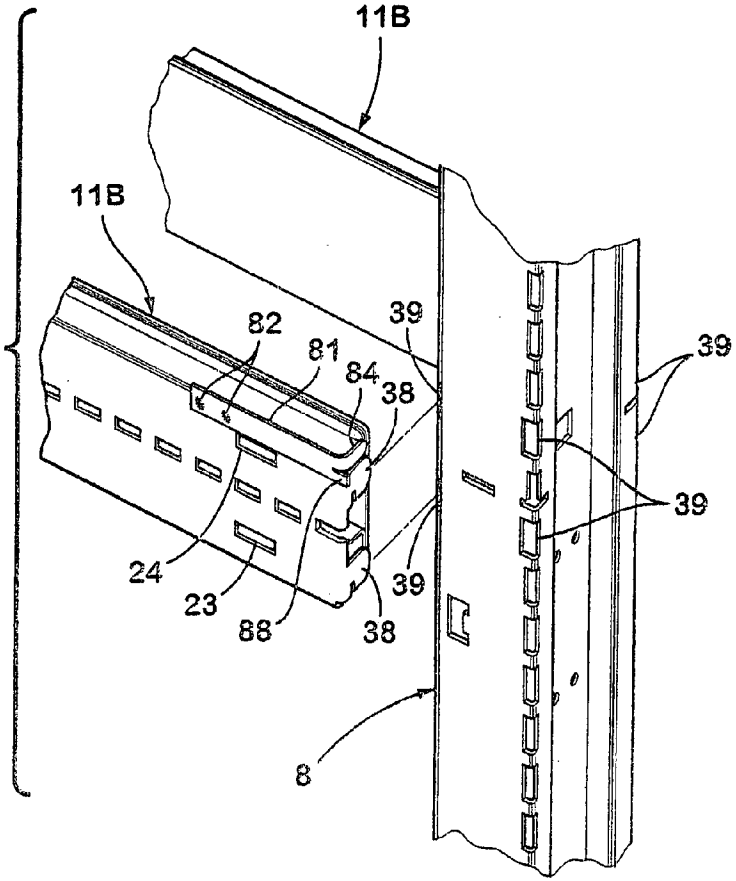
FIG. 17B is a fragmentary, exploded, perspective view of an end portion of an intermediate beam having a safety catch.
Figure 17A:
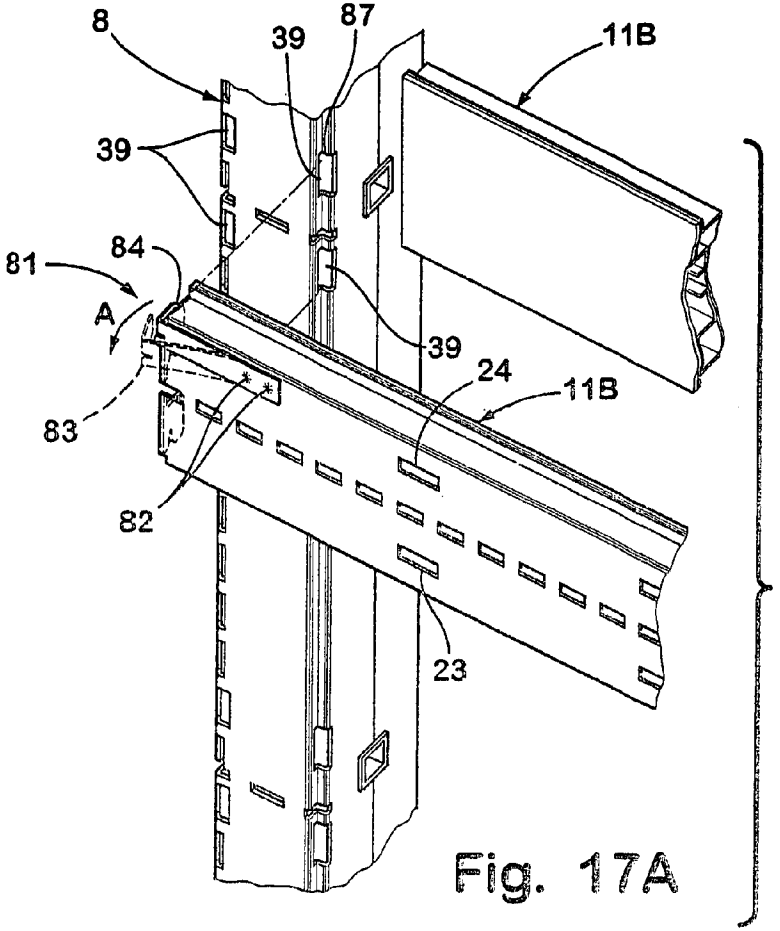
FIG. 17A is a fragmentary, exploded, perspective view of an end portion of an intermediate beam having a safety catch.

With further reference to FIGS. 17A and 17B, beam 11B may include a spring steel safety catch 81 to prevent inadvertent disengagement of hooks 38 from openings 39. The safety catch 81 may be spot welded to the structural beam 11B at 82, such that the end portion 83 is able to flex outwardly in the direction of the arrow "A" (FIG. 17A). During insertion of the hooks 38 into the openings 39, the end of the tab 84 contacts the outer surface 87 of the vertical frame member 87, and flexes in the direction of the arrow A. After insertion of hooks 38, beam 11B is shifted downwardly to engage the hooks 38. The end portion 83 of catch 81 will then return to a position parallel to the beam 11B, with the tab 84 snapping into the opening 39, such that the beam 11B cannot be inadvertently shifted upwardly to disengage hooks 38. To disengage the hooks 38, the small, straight tab 88 of catch 81 is grasped, and the end portion 83 is. flexed outwardly to disengage the tab 84, such that the beam 11B can be shifted upwardly to remove the hooks 38 from the openings 39. If required, the light duty intermediate beams 11A may also include a safety catch 81.

Figure 18A:
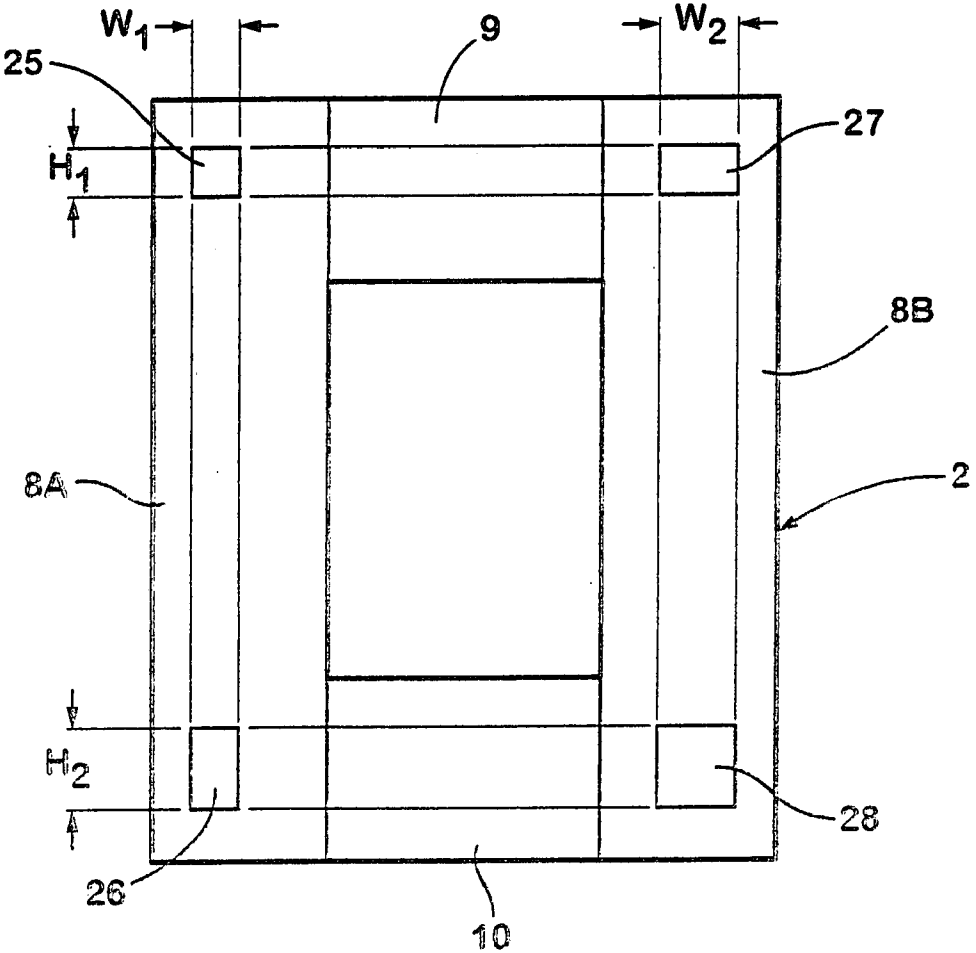
FIG. 18A is a schematic side elevational view of the partition frame of FIG. 3 illustrating the tolerancing scheme for mounting the cover panels.

FIG. 18A schematically illustrates the dimensions and tolerancing scheme provided by openings 25–28. The dimensions and configuration of openings 25–28 in frame 2 are chosen to permit greater production tolerances while alleviating tolerance stack ups that would otherwise lead to unsightly variations in the gaps between adjacent cover panels 7. As illustrated schematically in FIG. 18A, upper left opening 25 has a relatively small horizontal dimension W1, and a relatively small vertical dimension H1. Thus, a cover panel mounting clip 60 (see also FIG. 26) that is received in opening 25 will "pin" the upper left corner of cover panel 7, allowing little or no horizontal or vertical float. Opening 26 also has a relatively small width W1 preventing horizontal float of the lower left corner of cover panel 7. However, opening 26 has a vertical dimension H2 that is somewhat greater than dimension H1, such that the lower left corner of cover panel 7 can float vertically. Upper right opening 27 has a relatively small vertical dimension H1 that is the same as that of opening 25, substantially preventing vertical float of the upper right corner of cover panel 7. Opening 27 has a horizontal dimension W2 that is greater than horizontal dimension W1, such that the upper right corner of cover panel 7 can float horizontally. Opening 28 has a vertical dimension H2 and a horizontal dimension W2 such that the lower right corner of cover panel 7 can float both horizontally and vertically. Thus, although clips received in openings 25, 26, 27 and 28 will each retain a cover panel 7 to the frame 2, the right vertical side edge of cover panel 7 will float, and the lower horizontal edge of cover panel 7 will also float. It should be understood that this tolerancing scheme could also be utilized with the openings 25–28 in different orientations. For example, openings 28 could have a vertical dimension H1 and a horizontal dimension W1. In this example, opening 25 would have dimensions H2 and W2, and the dimensions of openings 26 and 27 would be switched from the configuration of FIG. 18A.

Figure 18B:
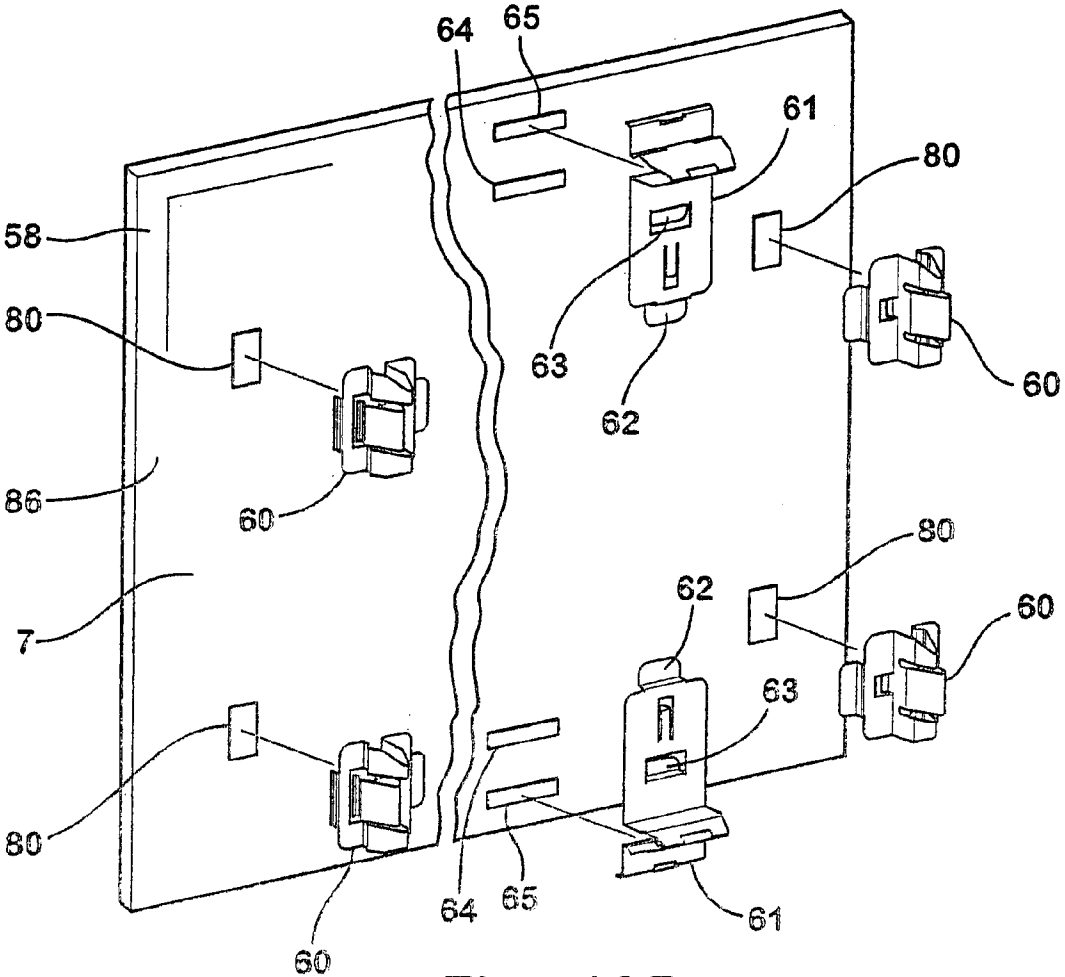
FIG. 18B is a fragmentary, exploded, perspective view showing the mounting of the cover panel retaining clips to a cover panel.
Figure 22:
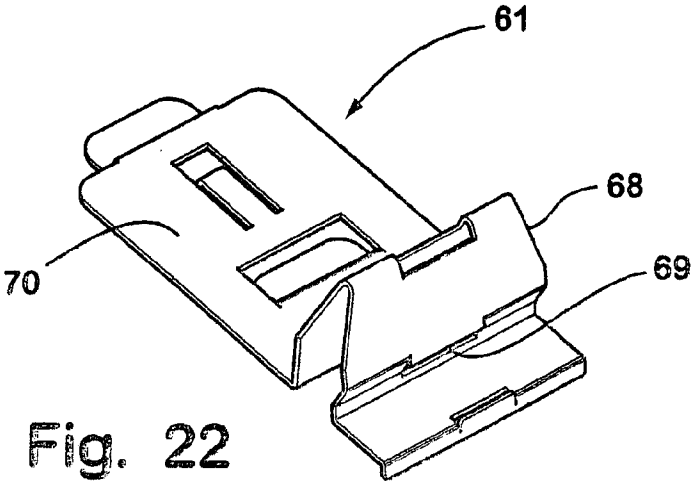
FIG. 22 is a perspective view of the top/bottom cover panel mounting clip of FIG. 19.
Figure 21:
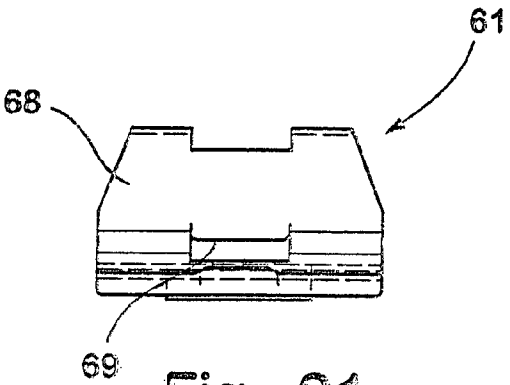
FIG. 21 is a right elevational view of the top/bottom cover panel mounting clip of FIG. 19.
Figure 20:
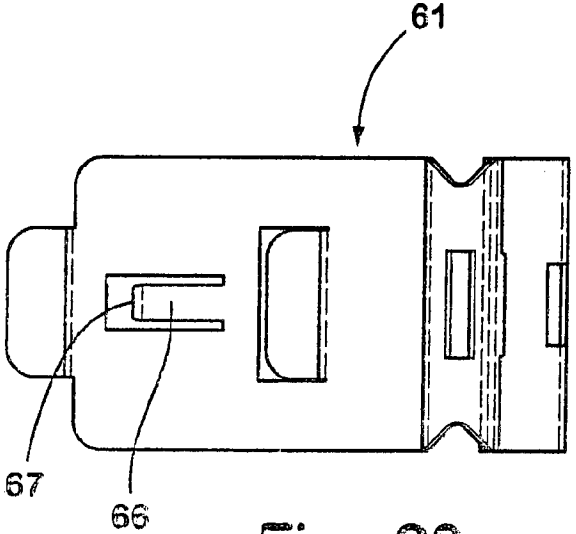
FIG. 20 is a top plan view of the top/bottom cover panel mounting clip of FIG. 19.
Figure 19:
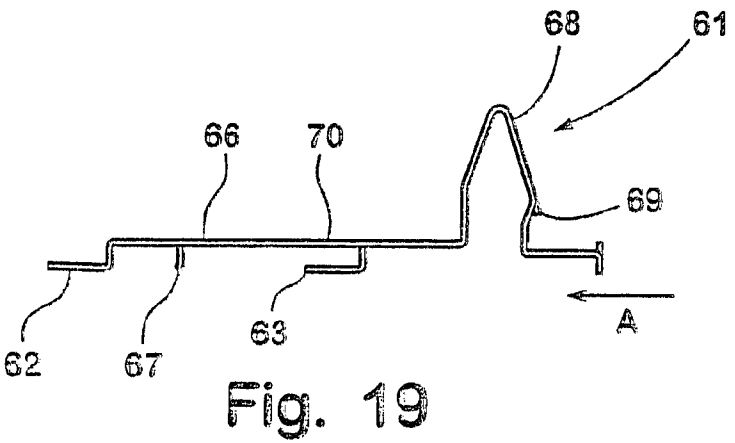
FIG. 19 is a front elevational view of the top/bottom cover panel mounting clip of FIG. 18.

With further reference to FIG. 18B, cover panel 7 includes a plurality of side clips 60, and a plurality of upper and lower clips 61. The side clips 60 are received in the openings 25, 26, 27, and 28 (FIGS. 7–10) of vertical frame members 8A and 8B. As described in more detail below, clips 60 (FIGS. 24–26) include a pair of outer V-shaped fingers 23 that are relatively rigid and prevent horizontal movement of cover panel 7 when the clips engage T-shaped openings 25 (FIG. 7) and 26 (FIG. 8). Clips 60 also include a relatively flexible center "finger" 75 that permits some horizontal movement of clip 60 when installed into a U-shaped opening 27 (FIG. 9) or 28 (FIG. 10). Significantly, T-shaped openings 25 and 26 will engage fingers 73 but provide clearance for finger 75. Conversely, U-shaped openings 27 and 28 are configured to only engage flexible center finger 75 while providing clearance for fingers 73 to thereby permit horizontal float. Thus, a single clip design 60 can be utilized to horizontally lock the position of cover panel 7 when engaging T-shaped openings 25 and 26, yet also may be utilized to permit horizontal float when engaging U-shaped openings 27 and 28. When a full height cover panel 7 is utilized, the upper and lower clips 61 engage the openings 23 in upper frame member 9, and the openings 24 in lower horizontal frame member 10. Alternately, if segmented cover panels 7 are utilized in conjunction with an intermediate horizontal beam 11A or 11B, the upper and lower clips 61 engage openings 23 and 24 of the intermediate horizontal beam 11A or 11B. With further reference to FIGS. 19–22, each upper and lower clip 61 includes a first tab 62 that is received in a first opening 64 in cover panel 7. Similarly, a second tab 63 of clip 61 is received in a second opening 65 in cover panel 7. Each upper and lower clip 61 includes a flexible retainer 66 having a tab 67. During installation of each upper and lower clip 61 in the openings 64 and 65, the tab 67 initially contacts the cover panel 7, and flexes to permit insertion of tabs 62 and 63 in openings 64 and 65. After the tabs 62 and 63 are fully engaged, the flexible retainer 66 returns to the position illustrated in FIGS. 19–22, and the tab 67 engages the edge of opening 64 to prevent inadvertent removal of the clip 61. The flexible V-shaped portion 68 is received in an opening 23 or 24 in partition frame 2, and a small retaining tab 69 engages the inner side wall of the frame member to thereby retain the cover panel 7. The base portion 70 of each upper and lower clip 61 is stationary relative to the cover panel 7, such that the flexible V-shaped portion 68 generates a force biasing the clip 61 and cover panel 7 in the direction of the arrow "A" (FIG. 19) when installed on the partition frame 2. At least one lower clip 61 and at least one upper clip 61 are utilized on each cover panel 7, and the clips 61 are rotated 180 degrees relative to one another, such that the biasing force of the upper and lower clips 61 acts vertically in opposite directions.

Figure 26:
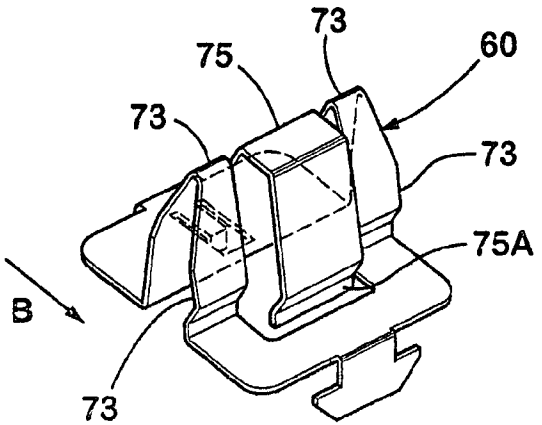
FIG. 26 is a perspective view of the cover panel mounting clip of FIG. 23.
Figure 25:
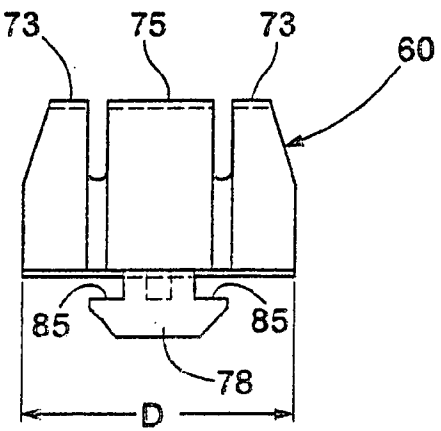
FIG. 25 is a right side elevational view of the cover panel mounting clip of FIG. 23.
Figure 24:
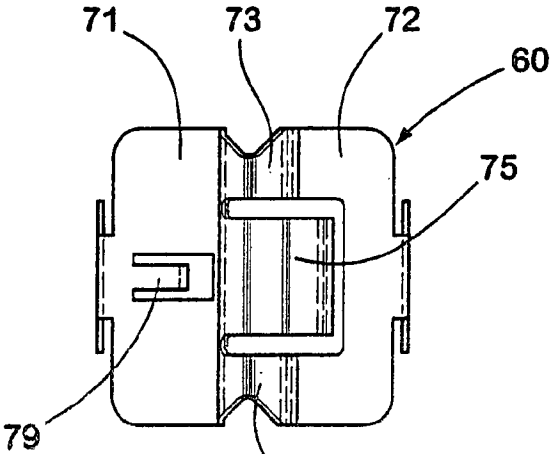
FIG. 24 is a top plan view of the cover panel mounting clip of FIG. 23.

With further reference to FIGS. 24–26, each side clip 60 includes first and second base portions 71 and 72 that are interconnected by a pair of outer V-shaped fingers 73. Each V-shaped portion 73 includes an angled portion 74 that bears laterally against the inner side edge of the opening in the partition frame 2 when installed to thereby retain the clip 60 and cover panel 7 to the partition frame 2. A larger central finger 75 similarly includes an angled portion 76 to retain the clip 60 and cover panel 7 to partition frame 2. Clip 60 includes first and second tabs 77 and 78 that are received in openings 80 of cover panel 7. A flexible retainer 79 contacts the surface 86 of cover panel 7, and biases the upper surfaces 85 of tabs 77 and 78 into engagement with the inner side of the cover panel frame member 58.

With reference to FIG. 7, each upper left opening 25 has a "T" shape including a vertical portion 89 having a width W1 and height H1. The dimension H1 is only slightly greater than the width D (FIG. 25) of clip 60 such that clip 60 cannot shift vertically when positioned in opening 25. Opening 25 also includes a horizontal cutout portion 90. When side clip 60 engages opening 25, the center finger 75 extends into the cutout portion 90 to horizontally locate cover panel 7, and does not provide a retaining function.

Outer fingers 73 are generally V-shaped and securely hold the cover panel 7 to prevent side-to-side movement. Center finger 75 is also V-shaped. However, end 75A of finger 75 is cantilevered, permitting clip 60 to shift in the direction of arrow "B" (FIG. 26) when clip 60 is received in a U-shaped opening 27 or 28. Such shifting may be required due to dimensional variations in the cover panel 7 and/or the sizes/locations of openings 25–28.

The shape of the mounting openings 25–28 in frame 2 determines which fingers of clip 60 engage the opening. T-shaped openings 25 and 26 engage fingers 73, thereby "locking" the horizontal position of left vertical edge of cover panel 7. In contrast, U-shaped openings 27 and 28 only engage center finger 75. Because the center finger 75 is much more flexible than outer fingers 73, the right vertical edge of cover panel 7 will "float" if the dimensions of cover panel 7 vary due to production tolerances and the like.

The side clip 60 is oriented such that the angled portion 76 of clip 60 extends into the cutout portion 90 of opening 25, and the angled portions 74 of outer fingers 73 engage the vertical edges 91 and 92 of opening 25. Each lower left opening 26 (FIG. 8) also has a T-shape, and includes a vertical portion 93 having a width W1 and height H2. Lower left opening 26 includes a cutout horizontal portion 94 that is substantially similar to the cutout portion 90 of upper left opening 25. Although the vertical portion 89 of upper left opening 25 has the same width W1 as the vertical portion 93 of lower left opening 26, the heights H1 and H2 of the vertical portions 89 and 93, respectively, are different. The dimensions W1 and H1 are chosen such that the upper left side spring clip 60 engages the upper left opening 25 with close tolerances, such that the upper left side spring clip 60 cannot shift horizontally or vertically within the upper left opening 25. However, the height 112 is greater than the height H1, such that the lower left side clip 60 can shift vertically within the lower left opening 26 to accommodate variations in the vertical distance between a pair of side clips 60 that due to production tolerances and the like will cause the position of the lower clip 60 to "shift" vertically within opening 26. However, the width W1 of lower left opening 26 prevents horizontal shifting of the lower left clip 60.

With further reference to FIGS. 9 and 10, the upper right opening 27 has a height H1 that is the same as height H1 of upper left opening 25, and lower right opening 28 has a height H2 that is the same as the height H2 of lower left opening 26. As discussed above, because the dimension H1 is only slightly greater than the width D (FIG. 25) of side clip 60, the side clip 60 in the upper right opening 27 will be closely located vertically. However, the height H2 of the lower right opening 28 is substantially greater than the width D of side clip 60, such that a side clip 60 located in the lower right opening 28 can shift vertically to accommodate dimensional variations.

Openings 27 and 28 each include a tab 95 with an edge 96. Openings 27 and 28 also include cutouts 97 adjacent tabs 95. When a side clip 60 is inserted into the openings 27 and 28, the center finger 75 of clip 60 engages the edge 96 of tab 95, and the outer fingers 73 are positioned within the cutouts 97, but do not contact the side edges 98 of cutouts 97. The outer fingers 73 of clip 60 are substantially less flexible than the center finger 75, such that the cover panel 7 is horizontally fixed due to the contact of the outer finger 73 with the openings 25 and 26. If the horizontal dimension between the left pair of side clips 60 on cover panel 7 and the right pair of side clips 60 on cover panel 7 varies, such variation will cause the position of the right edge of the cover panel 7 to vary because the side clips 60 located in the right openings 27 and 28 will "shift" horizontally due to the flexibility of center finger 75. Similarly, the uppermost pair of side clips 60 that are positioned in upper openings 25 and 27 is relatively fixed. If the vertical dimension between the upper pair of side clips 60 and the lower pair of side clips 60 varies, the lower pair of side clips 60 will "float" vertically within the lower openings 26 and 28 because the vertical dimension H2 of the lower openings is greater than the vertical dimension H1 of the upper pair of openings 25 and 27.

Figure 26B:
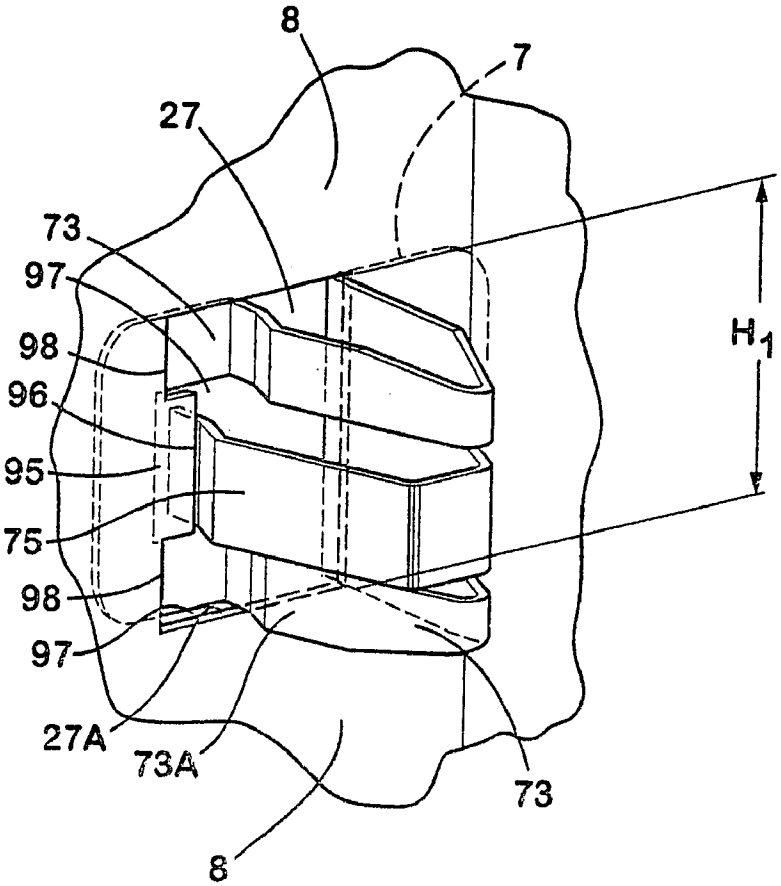
FIG. 26B is a fragmentary, perspective view showing a cover panel mounting clip extending through an opening in the sidewall of a vertical frame member.
Figure 26A:
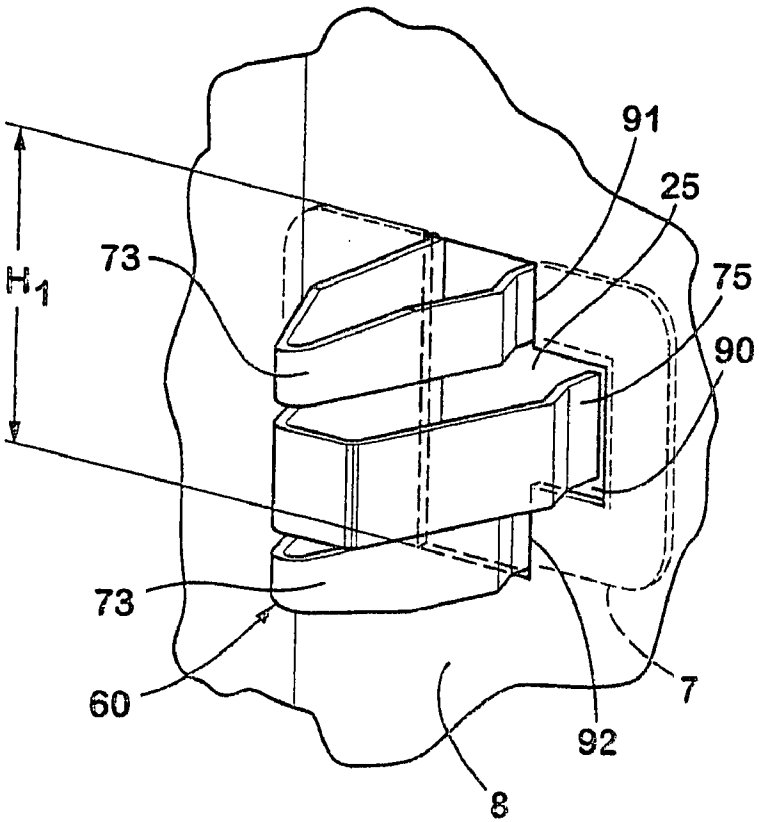
FIG. 26A is a fragmentary, perspective view showing a cover panel mounting clip extending through an opening in the sidewall of a vertical frame member.

FIG. 26A further illustrates the engagement of clip 60 in a T-shaped opening 25. As discussed above, outer legs 73 contact vertical edge portion 91 and 92 of opening 25, and thereby prevent horizontal movement of cover panel 7. Center fingers 75 extends into cutout 90. Cutout 90 is larger than finger 75, such that finger 75 does not contact the edges of opening 25 and thus does not provide any retaining action when received in opening 25. Clip 60 engages opening 26 in substantially the same manner as just described in connection with opening 25 except that opening 26 has a vertical dimension H2 that is greater than H1 to permit vertical shifting of clip 60 within opening 26.

With further reference to FIG. 26B, when clip 60 is received within a U-shaped opening 27, flexible center finger 75 will contact edge 96 of tab 95. Outer legs 73 are received in cutout areas 97 of opening 27. Cutout areas 97 are larger than legs 73, such that legs 73 do not contact the vertical side edges 98 of opening 27, such that legs 73 do not horizontally position cover panel 7 when received in opening 27. Because leg 75 is flexible, clip 60 can move horizontally within opening 27. Lower edge 73A of lower leg 73 contacts lower edge 27A of opening 27 to vertically support cover panel 7. Clip 60 engages lower U-shaped opening 28 in substantially the same manner as opening 27, except that lower opening 28 has a vertical dimension H2 that is greater than vertical dimension H1 to thereby permit vertical movement (float) of clip 60 within opening 28 due to dimensional variations and the like.

In summary, the upper left openings 25 in each panel frame 2 "fixes" the upper left corner of the associated cover panel 7 both horizontally and vertically, such that variations in horizontal dimensions will cause the right edge of the cover panel 7 and/or right side clips 60 to shift horizontally, and variations in the vertical dimensions of the cover panel 7 due to production tolerances, etc. will cause the lower edge of the cover panel 7 and/or lower clips 60 to shift vertically. Precisely locating or fixing the left edge of the cover panel 7 in this manner permits greater production tolerances while maintaining a specified variation in the horizontal gap between horizontally adjacent cover panels 7. Similarly, fixing the upper edge of cover panel 7 permits larger vertical tolerances while maintaining the required vertical gap between vertically adjacent cover panels 7 when segmented cover panels are utilized. Furthermore, this arrangement permits greater tolerancing of the dimensions between side clips 60, while providing proper positioning of panel 7 based on the upper left clip 60.

Figure 7A:
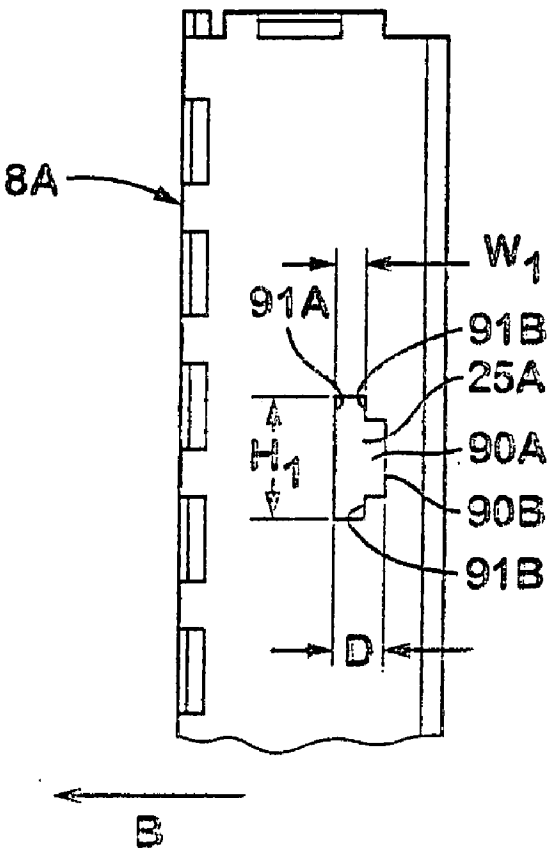
FIG. 7A is an enlarged view of an alternate embodiment of the aperture of FIG. 7.

With reference to FIG. 7A, an alternate embodiment 25A of the opening 25 is generally T-shaped and provides substantially the same cover panel mounting characteristics as described above in connection with opening 25. However, the opening 25A is oriented with the cutout 90A extending inwardly. The alternate opening 25A is utilized in conjunction with an alternate clip 60A described in more detail below, and illustrated in FIGS. 23A–23D. Clip 60A includes a center finger 75A and outer fingers 73A that operate in substantially the same manner as the fingers 73 and 75 of clip 60 described in detail above. The outer finger 73A tightly engages the side edges 91A and 91B of opening 25A to locate the cover panel 7. However, unlike opening 25, opening 25A has an overall horizontal dimension "D" that is relatively small such that the center finger 75A of clip 60A engages the side edge 90B of cutout 90A. Thus, the flexible center finger 75A will bias the cover panel outwardly in the direction of the arrow "B", ensuring that that-cover panel 7 is in tension to prevent bowing, bulging or other distortion of the cover panel 7.

Figure 9A:
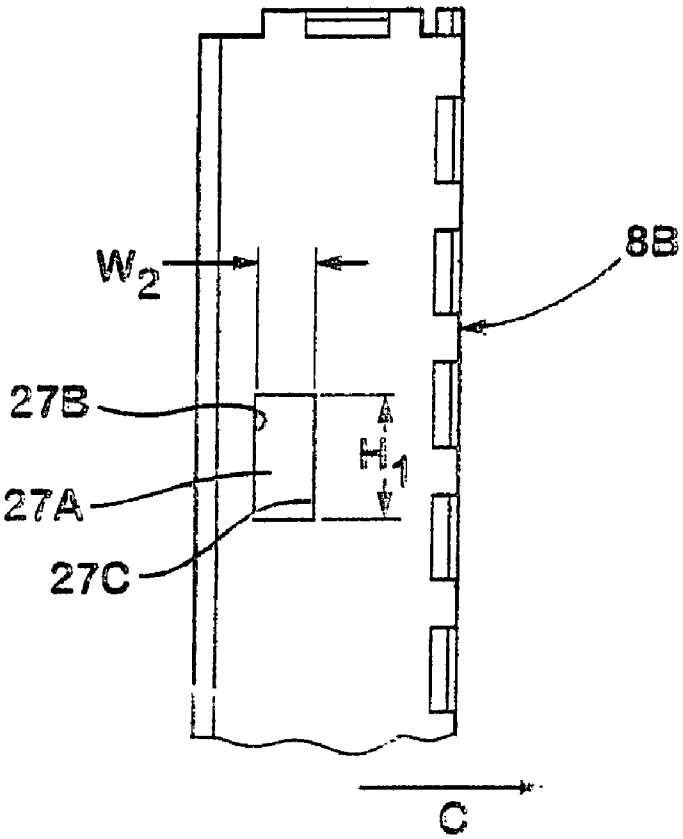
FIG. 9A is an enlarged view of an alternate embodiment of the aperture of FIG. 9.

With further reference to FIG. 9A, an alternate embodiment 27A of opening 27 provides substantially the same cover panel mounting characteristics as described above with respect to opening 27. The width W2 of opening 27A is relatively large, such that only the flexible center finger 75A of clip 60A engages the side edge 27B of opening 27A. The base portion 60B (FIG. 23B) of clip 60A contacts the side edge 27C of opening 27A. The engagement of flexible center finger 75A along side edge 27B of opening 27A biases the cover panel 7 in the direction of the arrow "C" (FIG. 9A), thereby creating horizontal tension in cover panel 7 to prevent bowing, bulging or other deformation of the cover panel 7.

A lower opening (not shown) having substantially the same shape as opening 25A, only having a height H2 may be utilized to provide substantially the same cover panel mounting characteristics as opening 26 described in detail above. Similarly, a lower right opening (not shown) having substantially the same shape as opening 27A may be provided, with the lower opening having a height H2, such that the lower right opening would provide substantially the same mounting characteristics as opening 28 described in detail above. Thus, the shape of the openings 25A and 27A provide a horizontal tension on cover panel 7, but otherwise provide the same tolerancing characteristics as described in detail above in connection with openings 25–28, and illustrated schematically in FIG. 18A.

Figure 23:
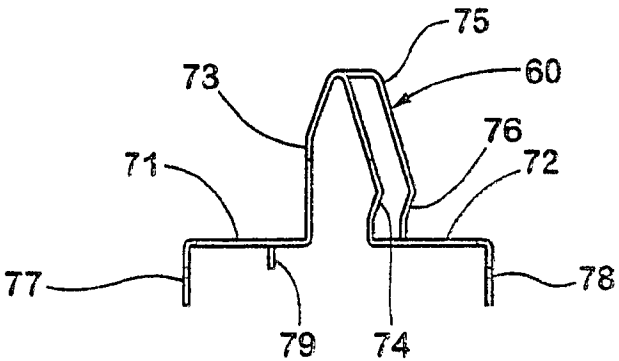
FIG. 23 is a front elevational view of a cover panel clip utilized along the left and right vertical side edges of a cover panel.
Figure 23C:
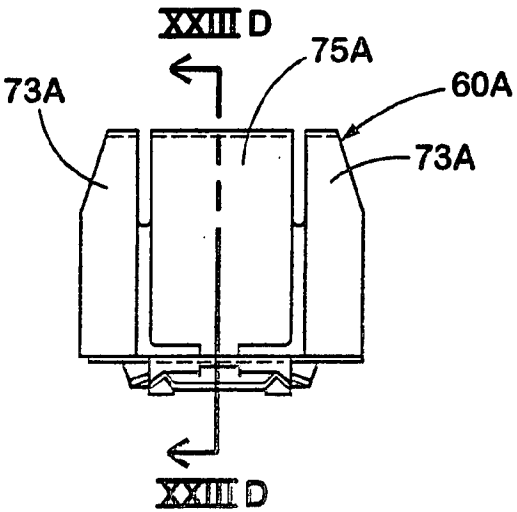
FIG. 23C is a front elevational view of the clip of FIG. 23A.
Figure 23D:
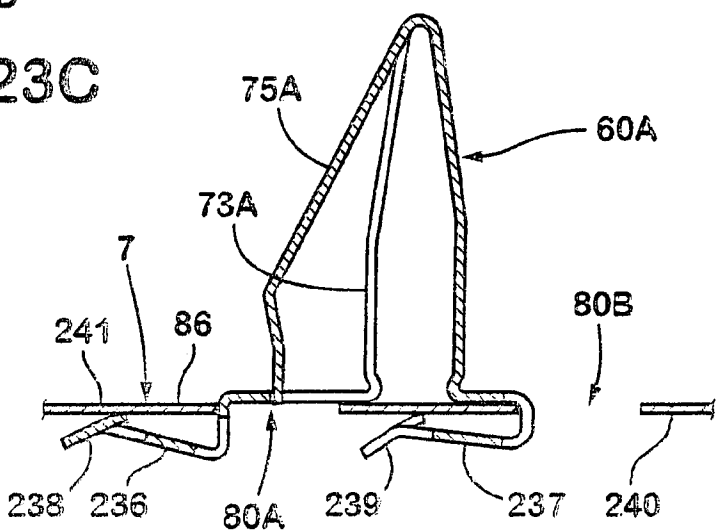
FIG. 23D is a cross-sectional view taken along the line XXIIID—XXIIID.
Figure 23A:
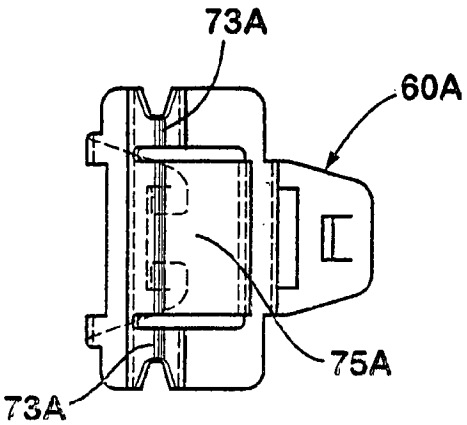
FIG. 23A is a top plan view of an alternate embodiment of the cover panel clip illustrated in FIGS. 23–26.
Figure 23B:
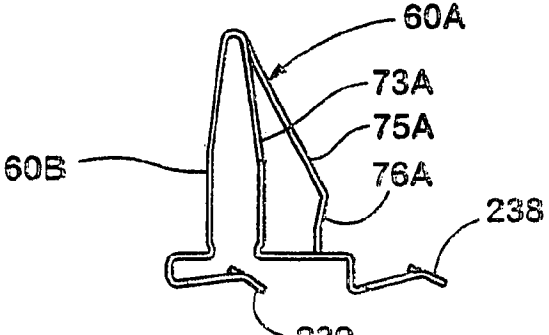
FIG. 23B is a side elevational view of the clip of FIG. 23A.

With reference to FIG. 23D, clip 60A includes a pair of flexible extensions 236 and 237, which are received within openings 80A and 80B in the rear surface 86 of cover panel 7. When installed in the position illustrated in FIG. 23D, retainers 238 and 239 of flexible extensions 236 and 237 engage the inner surface 240 of metal sheet 241 of cover panel 7, thereby retaining the clip 60A on the cover panel 7.

Figure 27:
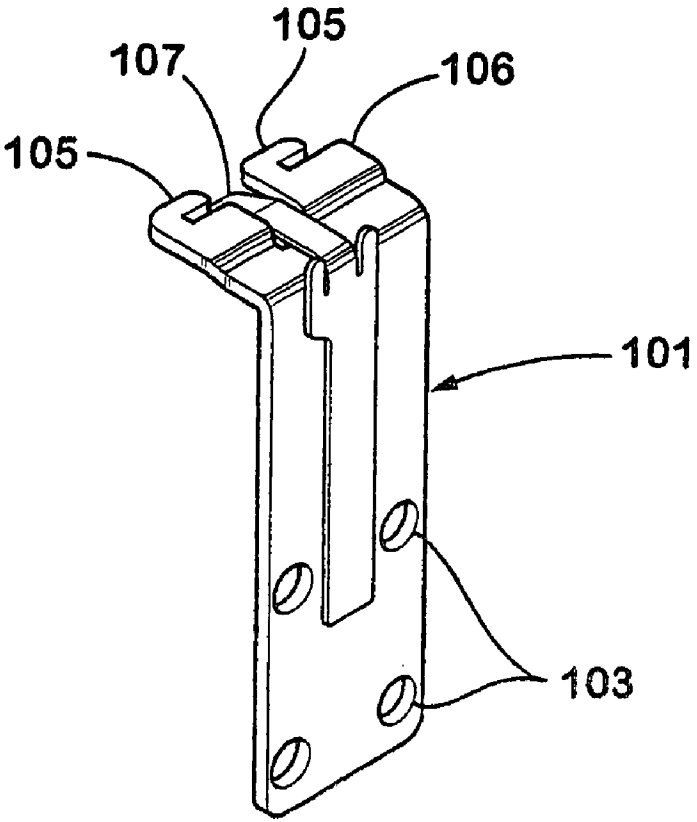
FIG. 27 is a perspective view of an upper connector bracket for mounting an off-module panel.

With reference to FIG. 1, partition system 1 may include an off-module panel 100 that includes a partition frame 2 having exactly the same construction as the other partition panels in the system (see, e.g. FIGS. 2–5). An upper bracket 101 and lower bracket 102 are connected to the panel 100 and interconnect the panel 100 to the upper horizontal row of slots 12 and lower horizontal row of slots 13 of the partition frame 2 to which the off-module panel 100 is being connected. The in-line row of partitions that the off-module panel is connected to is commonly known as a "spine wall". With further reference to FIG. 27, upper connector bracket 101 includes openings 103 that receive conventional fasteners or the like to secure the bracket 101 to the openings 104 (see also FIG. 6) of a frame upright 8. Bracket 101 includes a horizontal extension 106 with a pair of horizontally oriented hooks 106 that are received in selected ones of the upper horizontal row of slots 12. If the off-module panel 100 is of a lesser height than the adjacent panel frame 2 to which it is being connected, the hooks 105 may be received in the horizontal row of slots 15 of a structural intermediate beam 11B. A flexible catch 107 is made of a spring steel, and extends downwardly slightly. During installation, the hooks 105 are first inserted into the slots 12 and then shifted horizontally to engage the hooks 105. During insertion of hooks 105, catch 107 flexes downwardly upon contacting the frame member 9, and then springs back into the slot 12 as the bracket 101 is shifted to fully engage the hooks 105. The catch 107 thus prevents inadvertent disengagement of hooks 105. To disengage the bracket 101, the catch 107 is flexed out of engagement with the slot 12, and the bracket 161 is shifted horizontally to disengage hooks 101.

Figure 28:
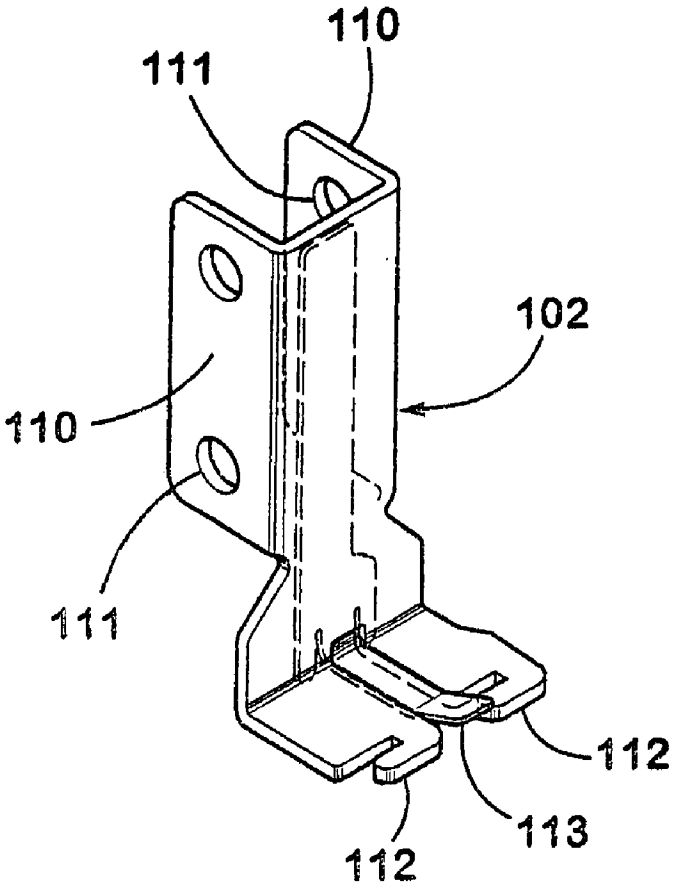
FIG. 28 is a lower bracket for mounting an off-module panel.

With reference to FIG. 28, lower bracket 102 includes a pair of flanges 110, each of which has a pair of openings 111. When installed, the flanges 110 of bracket 102 extend around the leg 108 (see also FIG. 3) of frame 2, and conventional fasteners or the like (not shown) are received in the openings 111 and 109 to secure the bracket 102 to the leg 108. Bracket 102 includes a pair of horizontally oriented hooks 112 and a flexible catch 113. The hooks 112 and catch 113 operate in substantially the same manner as the hooks 105 and catch 107 of upper bracket 101, as described above. The upper and lower brackets 101 and 102 permit the off-module panel 100 to be connected to a frame 2 at substantially any horizontal location.

Figure 29:
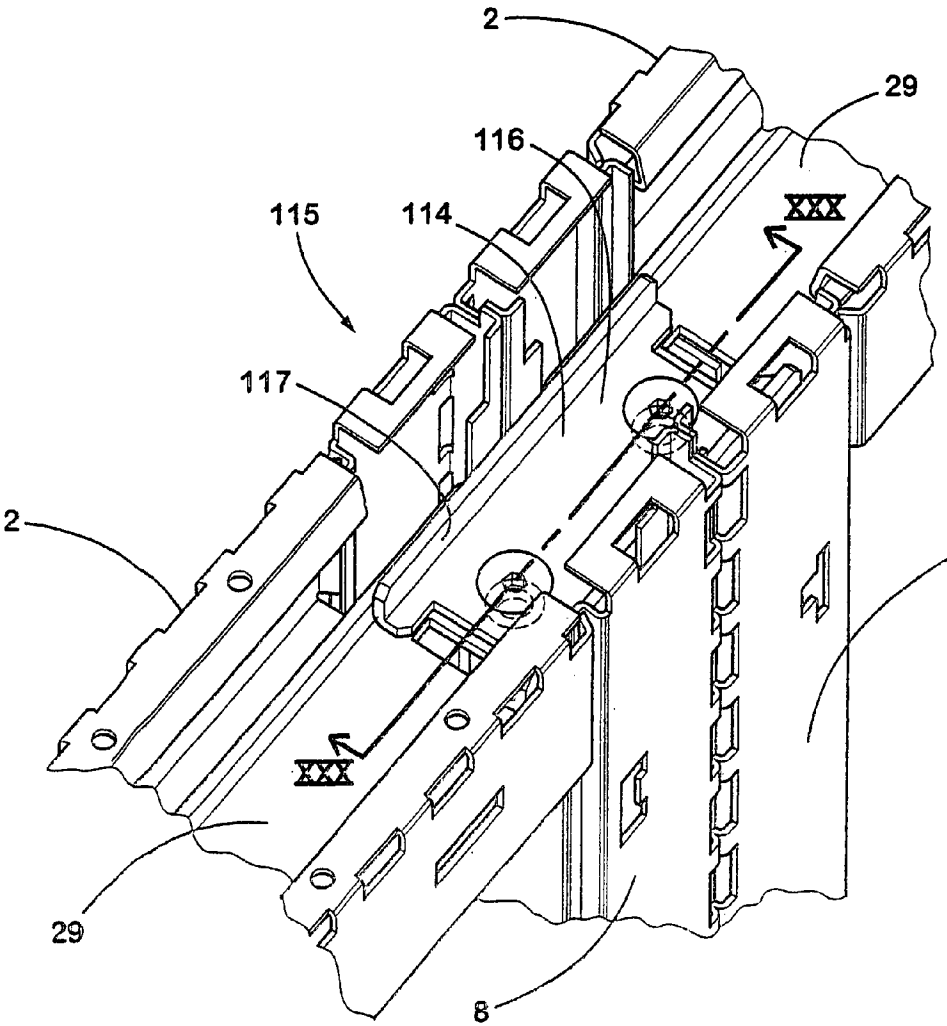
FIG. 29 is a fragmentary, perspective view of an in-line connector.
Figure 29A:
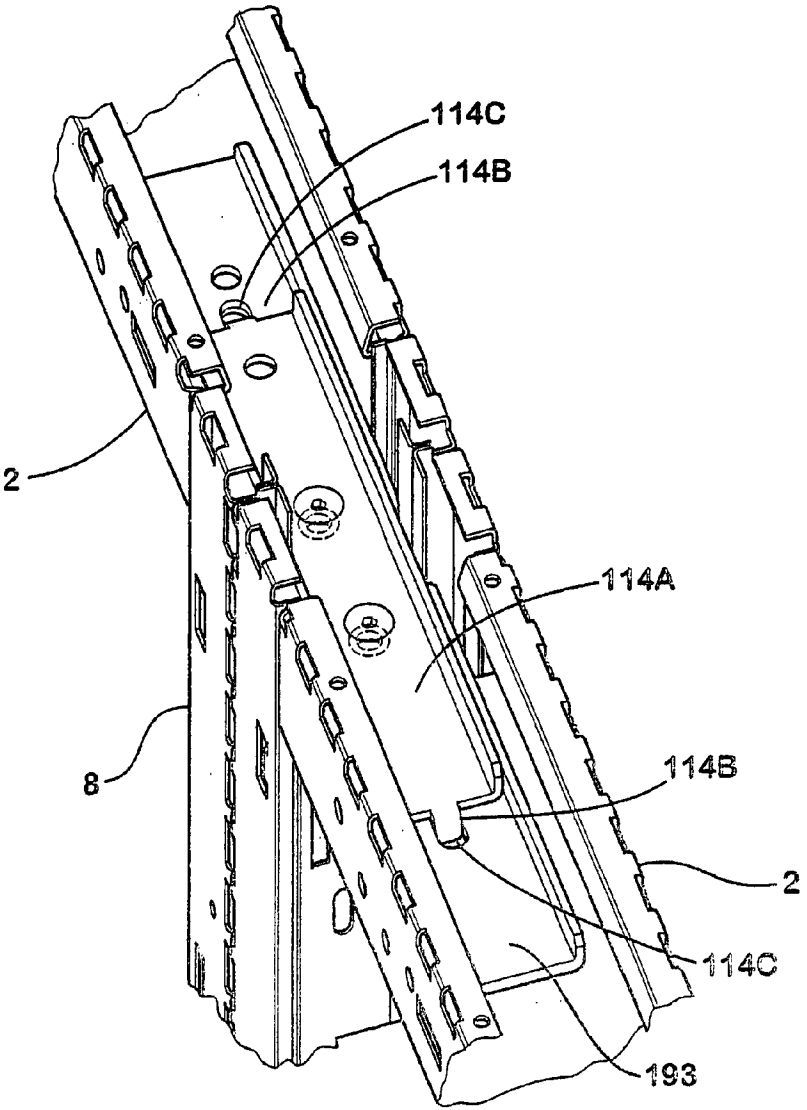
Figure 29C:
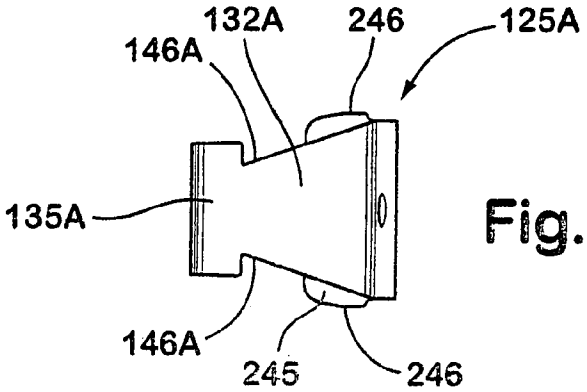
Figure 29D:
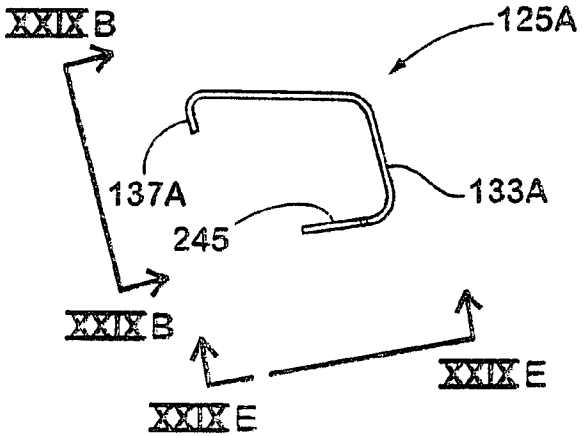
Figure 29B:
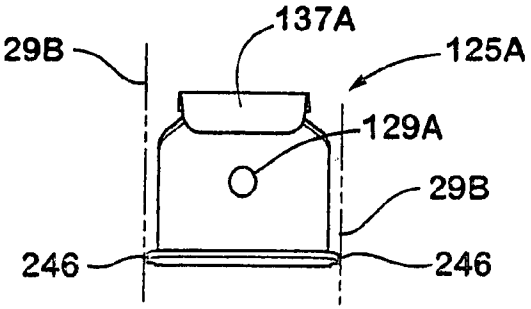
Figure 29E:
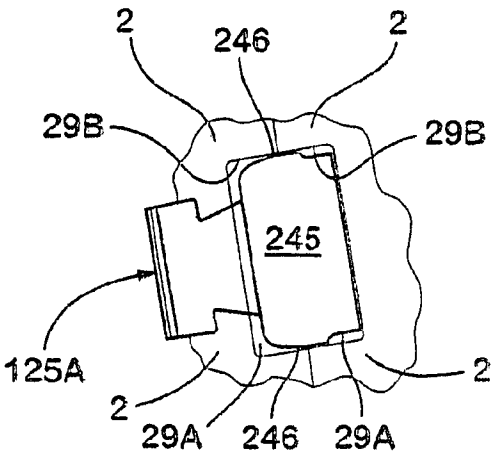
Figure 30:
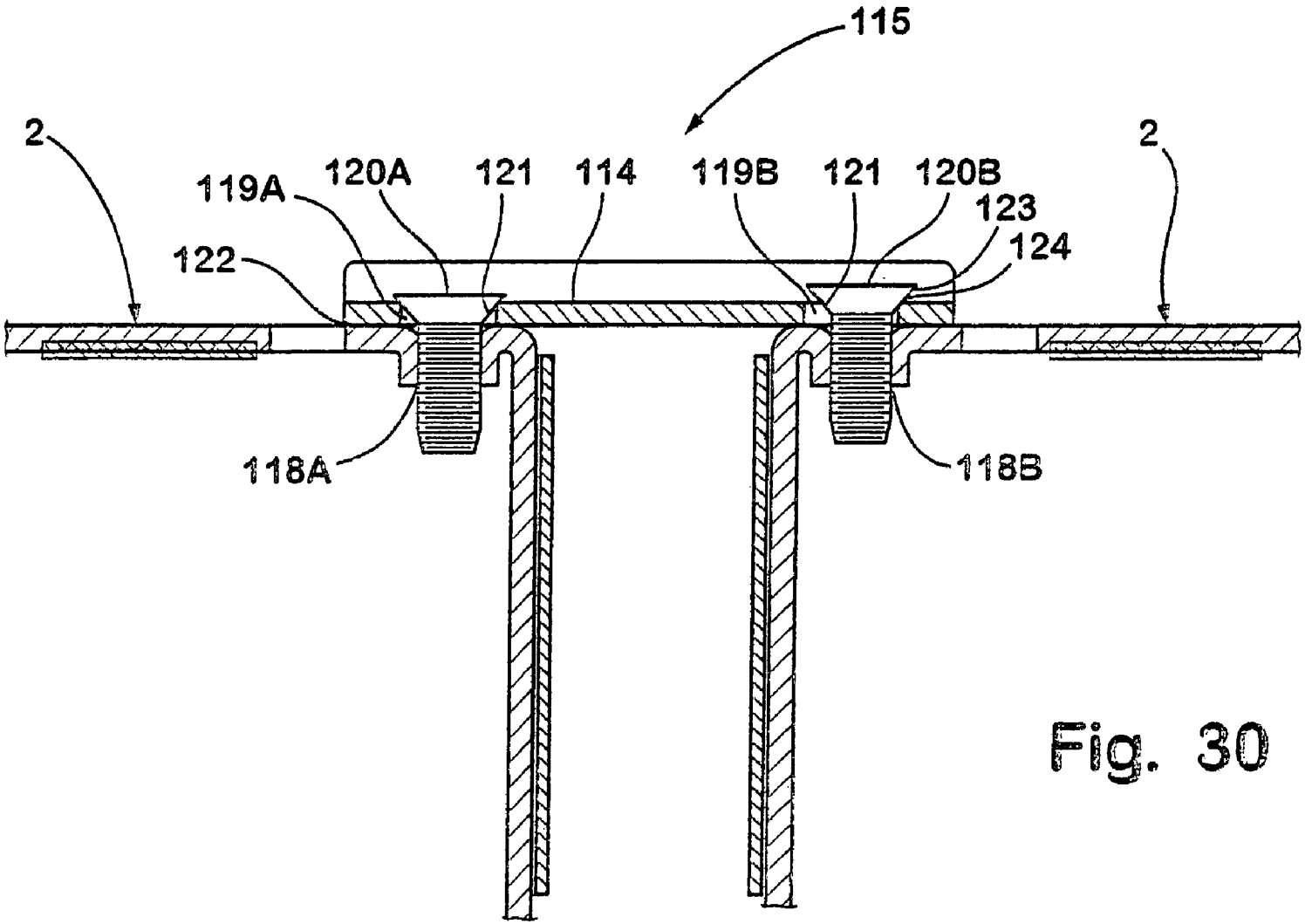
FIG. 30 is a cross-sectional view of the in-line connector taken along the line XXX—XXX.

With further reference to FIG. 29, an in-line connector bracket 114 is provided to interconnect a pair of adjacent panel frames 2 to form an in-line junction 115. Bracket 114 has a base web 116 and a pair of upstanding flanges 117, such that the bracket 114 has a shell U-shaped cross section. With further reference to FIG. 30, a pair of threaded openings 118 in the frame 2 threadably receive fasteners 120A and 120B, each of which has a conventional conically shaped head 121. The fasteners 120A and 120B extend through the clearance openings 119A and 119B of bracket 114. During assembly, the fastener 120A is first tightened, drawing the in-line bracket 114 into tight contact with the upper surface 122 of frame 2. The fastener 120B is then threadably engaged in the threaded opening 118B. The distance between the openings 119A and 119B is somewhat smaller than the spacing between the openings 118A and 118B when the pair of adjacent frames 2 are abutting one another. Thus, the outer conical surface 123 of head 121 of thread fastener 120B will contact the edge 124 of clearance hole 1 19B. As the threaded fastener 120B is further tightened, the adjacent frames 20 will thus be drawn or forced together into tight contact with one another. Furthermore, the upstanding flanges 117 of bracket 114 have a width that is the same or less than the width of channels 29 along the upper edge of the adjacent frames 2, such that the bracket 114 also serves to align the adjacent frames 2 into the same plane.

Figure 31:
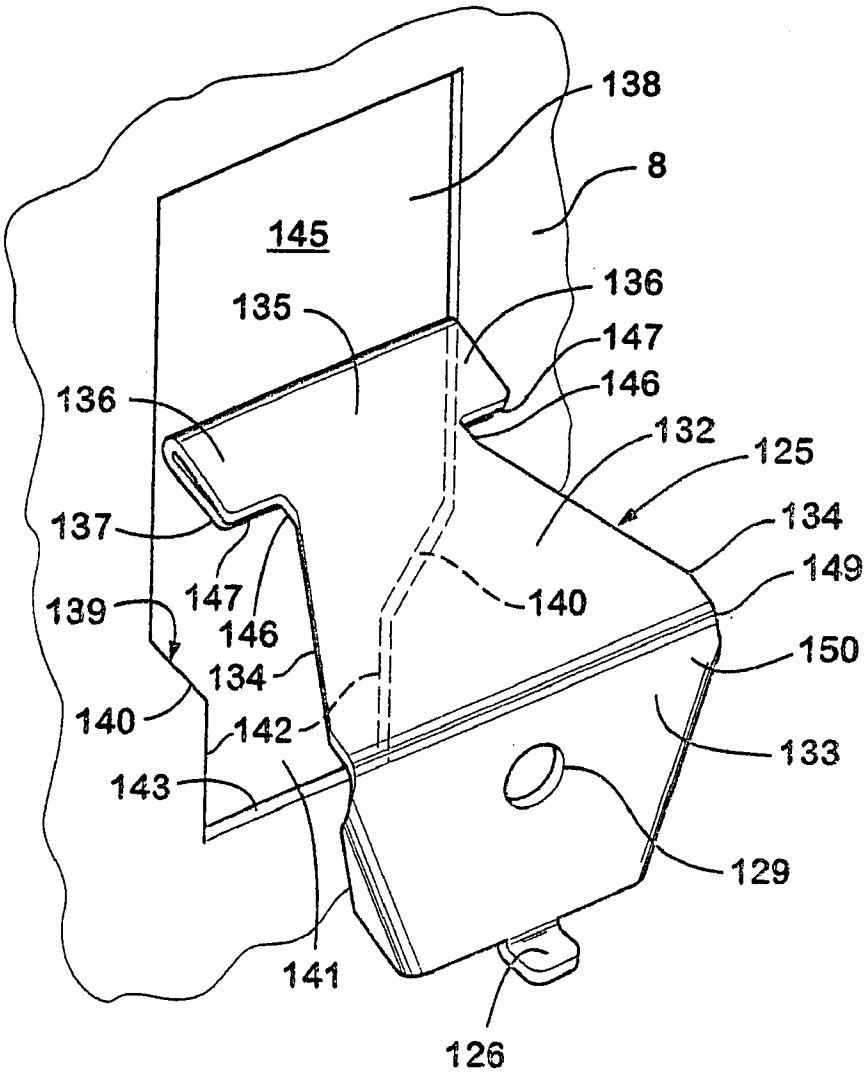
FIG. 31 is a perspective view of a lower in-line connector bracket.
Figure 32:
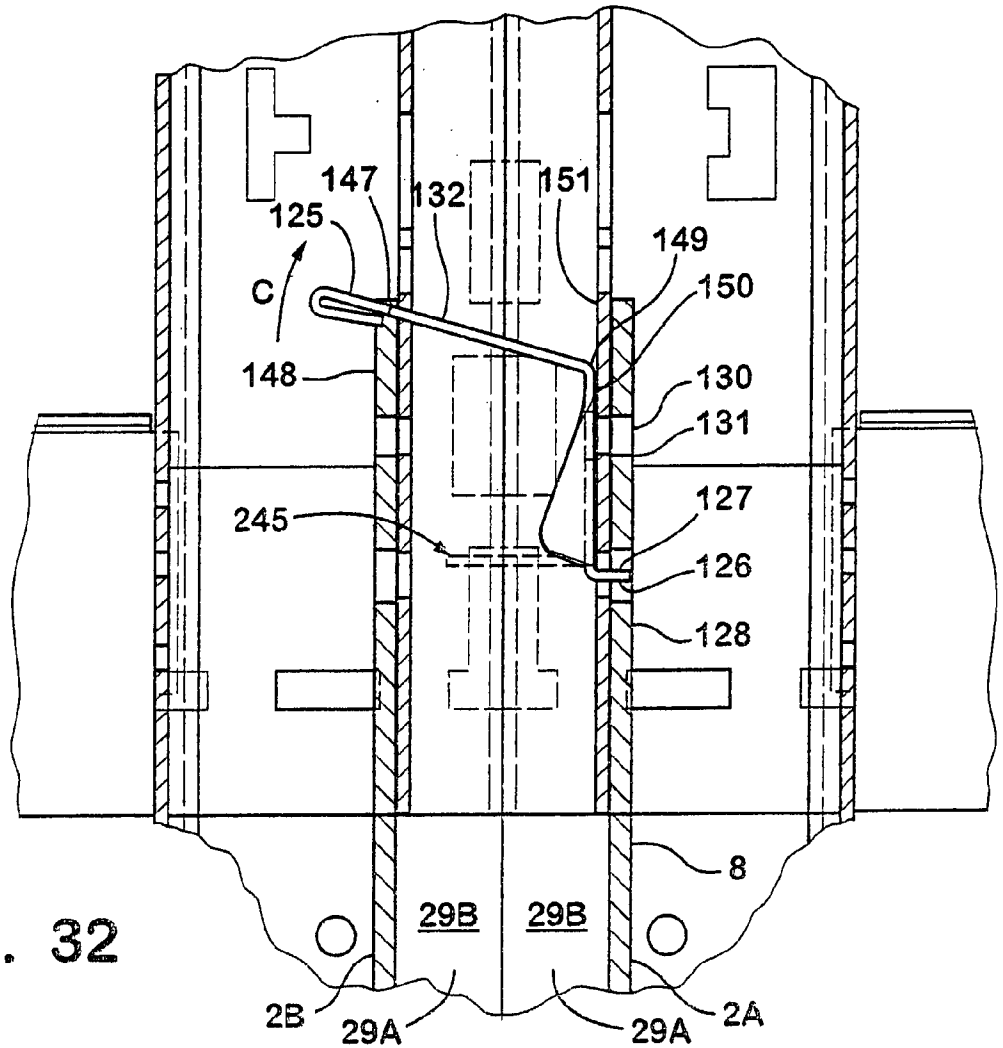
FIG. 32 is a cross-sectional view of a portion of a pair of adjacent partition panels showing the engagement of the bracket of FIG. 31 with the partition panels.

With further reference to FIG. 31, a lower in-line connector bracket 125 is utilized to interconnect the adjacent panels 2 adjacent the lower corners thereof. Bracket 125 includes a small tab 126 that is received in an opening 127 (see also FIG. 32) in a side wall 128 of vertical frame member 2. Opening 129 in bracket 125 receives a threaded fastener 130 that engages threaded opening 131 in side wall 128 of vertical frame member 8 to thereby secure the bracket 125 to the frame 2A. Bracket 125 also includes a tongue 132 that extends from flange 133. Tongue 131 includes tapered edges 134 and an enlarged end portion 135 with extensions 136. A flap 137 is folded over to provide additional strength for the end portion 135. Vertical frame member 8 includes an opening 138 with a lower edge 139 having tapered portions 140. Lower edge 139 also defines a cutout 141 having side edges 142 and a lower edge 143.

Figure 33:
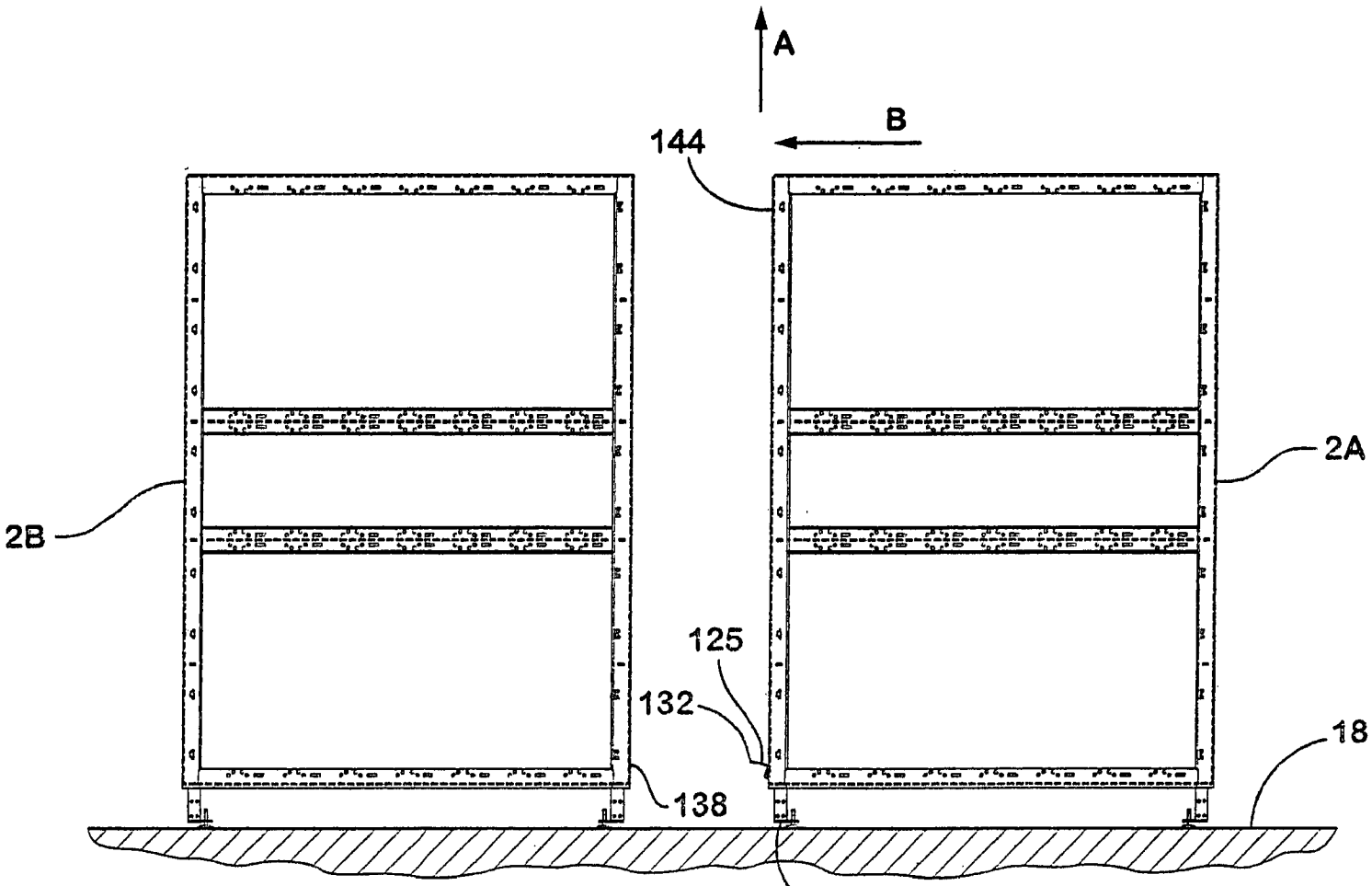
FIG. 33 is a side elevational view illustrating the assembly of a pair of side-by-side partition frames.

With further reference to FIG. 33, bracket 125 is first secured to the side edge 144 of a first partition frame 2A. The side edge 144 of frame 2A is then lifted slightly, and the tongue 132 of bracket 125 is inserted into the large upper portion 145 (see also FIG. 31) of opening 138 of the adjacent partition frame 2B. Edge 144 of partition frame 2A is then lowered, such that the root portions 146 of edges 134 of bracket 125 fit closely against the edges 142 of cutout 141. As the edge 144 of partition frame 2A is lowered, the tongue 132 will engage the lower edge 143 of cutout 141, such that the glide 16A of partition frame 2A is elevated or held slightly off the floor surface 18. The upper bracket 114 is then installed by tightening the threaded fasteners 120A and 120B. As the fasteners 120A and 120B are tightened, the side edge 144 of partition frame 2A is forced downwardly. The edges 147 of bracket 125 are brought into contact with the inner side surface 148 (FIG. 32) of partition frame 2B. As the fasteners 120A and 120B are further tightened, the tongue 132 will bend upwardly about the bend 149 defined between the tongue 132 and the web 133. The distance between the edges 147 and the web 133 is selected to ensure that the adjacent frames 2A and 2B will not vertically align without deformation of the bracket 125. As the tongue 132 flexes upwardly, the tongue 132 is placed in tension such that the upper portion 150 of web 133 bends outwardly slightly from the outer surface 151 of vertical frame member 8. The tension on tongue 132 and deformation of web 133 thereby tightly pulled the adjacent frames 2A and 2B into abutting engagement with one another. Furthermore, the root portions 146 of tongue 132 closely engage the edges 142 of cutout 141, such that the adjacent frames 2A and 2B are also aligned in the same vertical plane.

An alternate embodiment 114A of the in-line connector bracket may also be utilized to interconnect a pair of adjacent panel frames 2. The bracket 114A is substantially the same as bracket 114 described in detail above, except that bracket 114A includes a pair of downwardly extending tabs 114B that are received within openings 114C of bracket 193. Tabs 114B are closely received within the openings 114C to thereby maintain the alignment of the bracket 114A and the adjacent partition frames 2.

With further reference to FIGS. 29B–29E, an alternate embodiment 125A of the lower in-line connector bracket includes a tongue 132A with an enlarged end portion 135A that interconnects a pair of adjacent panel frames 2 in substantially the same manner as described in detail above in connection with in-line connector bracket 125. However, unlike bracket 125 described above, the root portions 146A of bracket 125A fit loosely within the cutout 141 of opening 145 (see also FIG. 31), such that the tongue 132A of bracket 125A does not substantially align the adjacent panel frames 2. Bracket 125A includes a lower extension 245 having opposite side edges 246 that fit closely against the side walls 29B of vertical channels 29A (FIG. 29E) of the adjacent partition frames 2. The lower extension 245 is also illustrated in dashed lines in FIG. 32 to further illustrate the positioning and alignment features of the lower extension 245. Tongue 132A includes a downwardly extending flap 137A that provides stiffness to the enlarged end portion 135A of bracket 125A.

Figure 35:
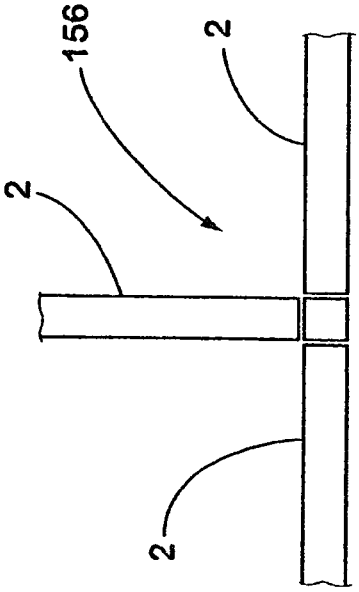
FIG. 35 is a schematic plan view of three adjacent partition panels that are interconnected to form a T junction.
Figure 34:
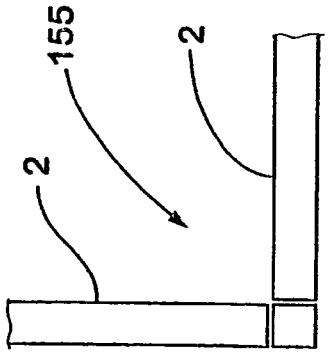
FIG. 34 is a schematic plan view of a pair of partition panels forming an L junction.
Figure 38:
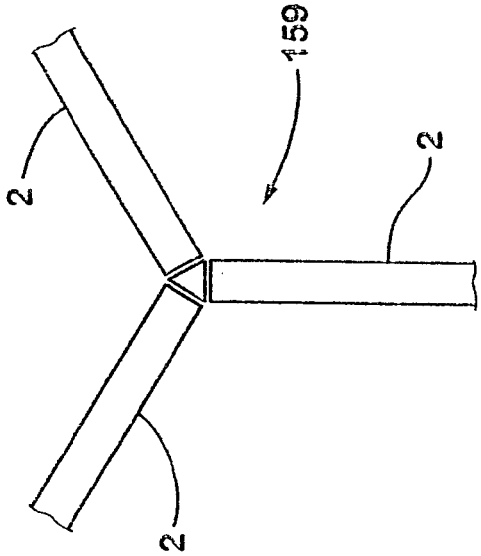
FIG. 38 is a schematic plan view of three adjacent panels that are interconnected at 120° angles relative to one another to form a Y junction.

With further reference to FIG. 34, a pair of adjacent partition panel frames 2 may also be interconnected to form an L junction 155 when seen in plan view. The adjacent panel frames may also be joined to form a T junction 156 (FIG. 35), an X junction 157 (FIG. 36), a V junction 158 (FIG. 37), or a Y junction 159 (FIG. 38).

Figure 39:
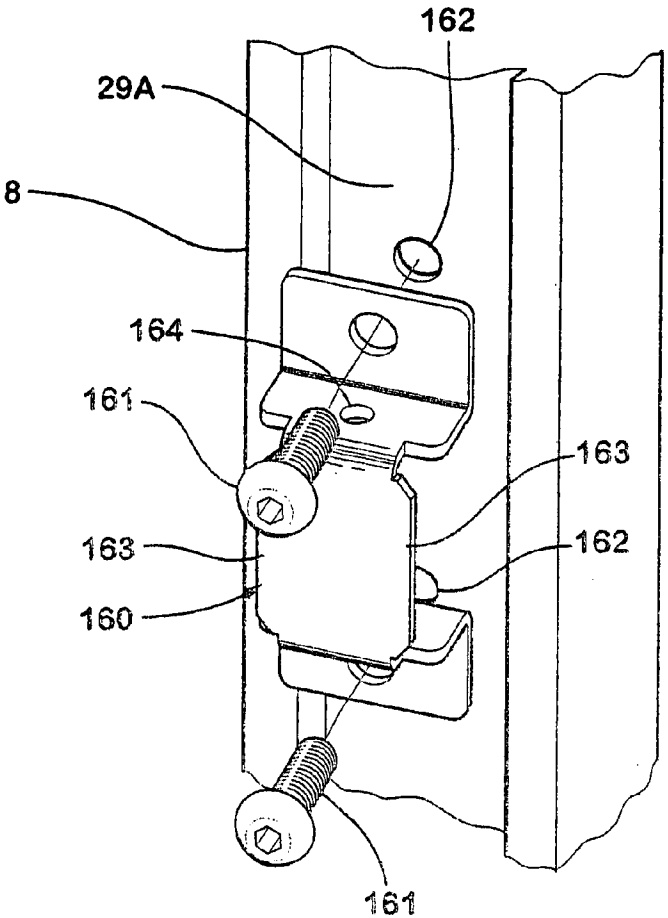
FIG. 39 is a partially fragmentary perspective view of a portion of a vertical frame member and a bracket that interconnects the panels to form the L, T, X, V, Y junctions of FIGS. 34–38.

With further reference to FIG. 39, a bracket 160 is one of the components utilized to form the junctions illustrated in FIGS. 34–38. Bracket 160 is secured within the channel 29 of a vertical frame member 8 via conventional threaded fasteners 161 that are received in threaded openings 162 of vertical frame member 8.

Figure 36:
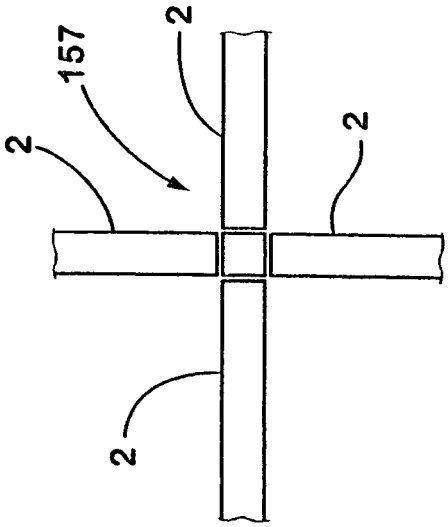
FIG. 36 is a schematic plan view of four adjacent panels that are interconnected to form an X junction.
Figure 40:
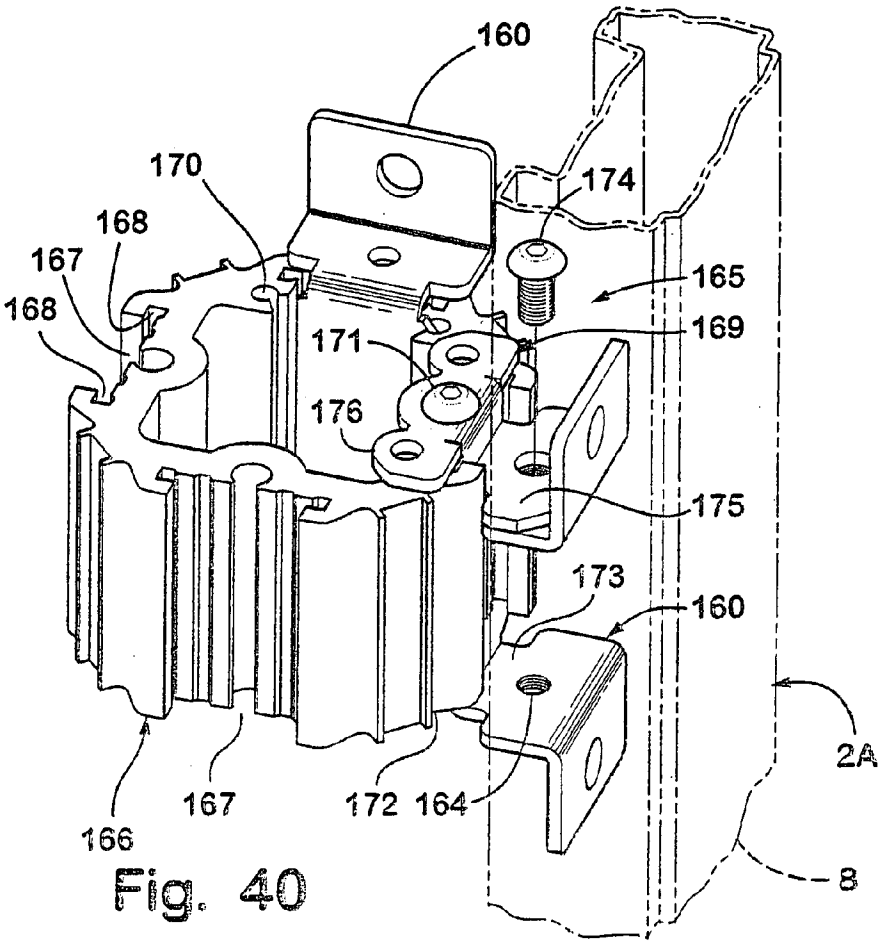
FIGS. 40–40B are perspective views illustrating bracket assemblies that may be utilized to interconnect the panels to form the L, T, and X plan configurations.
Figure 40A:
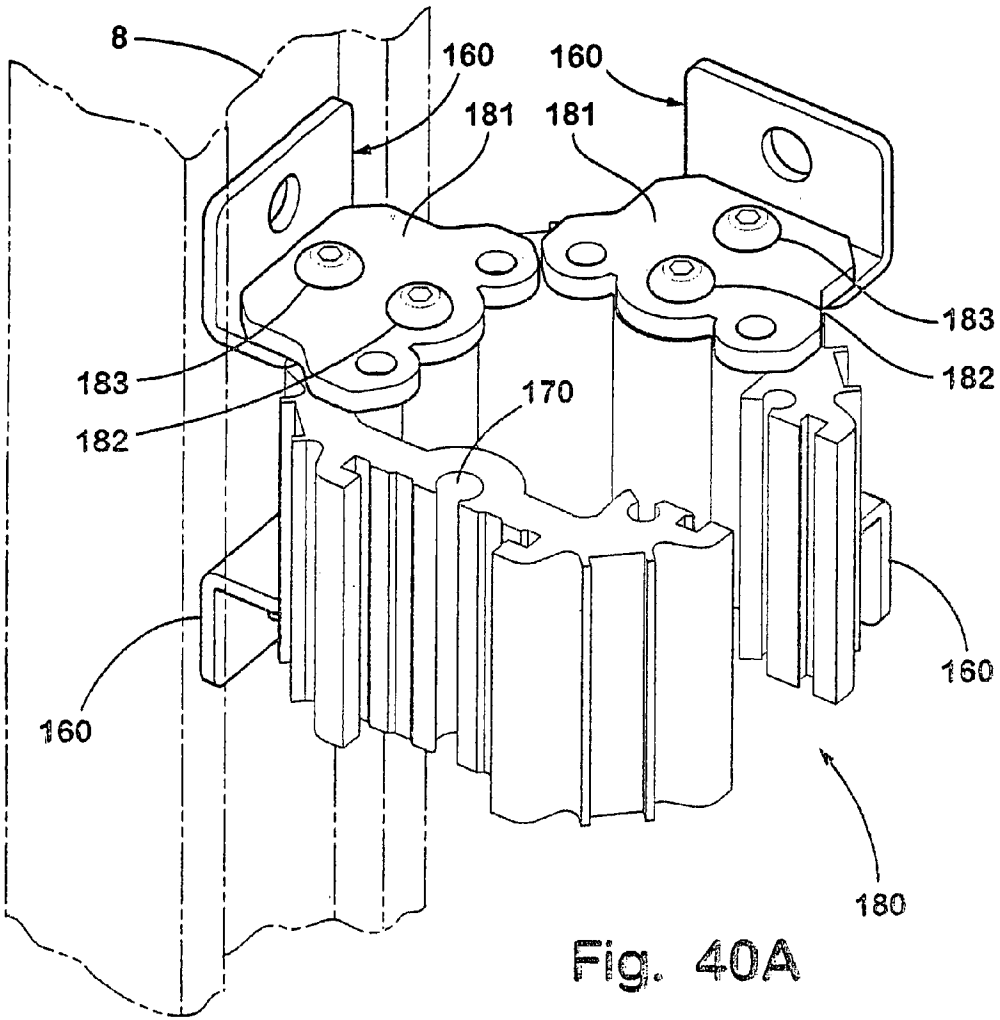
Figure 40B:
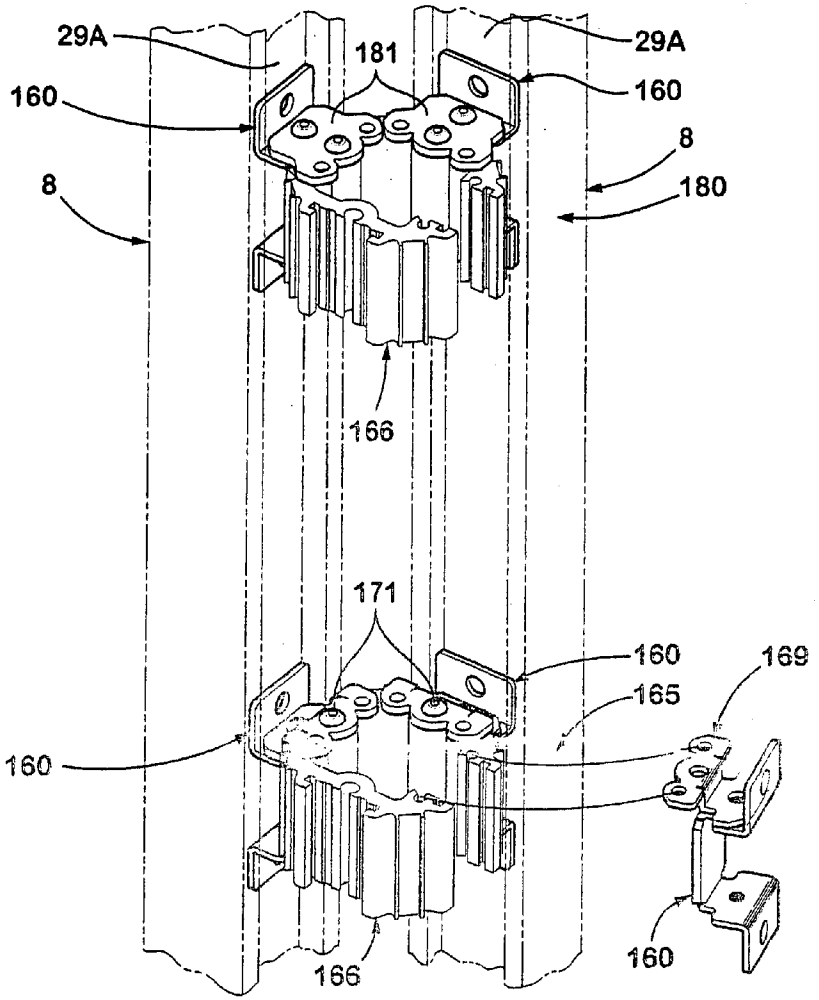

With further reference to FIGS. 40–40B, upper and lower bracket assemblies 180, 165, respectively include an extrusion 166 that may be utilized to form either an L junction 155 (FIG. 34), a T junction 156 (FIG. 35), or an X junction 157 (FIG. 36). Extrusion 166 includes four channels 167, each of which includes a pair of opposed slots 168. During assembly, a bracket 160 is first secured to the vertical frame member 8 adjacent the lower end thereof in vertical channel 29A. Extrusion 166 of lower bracket assembly 165 is then placed on the bracket 160 by sliding the extrusion 166 downwardly with the edges 163 of bracket 160 being received in the opposed slots 168 of channel 167. A retainer bracket 169 is then secured to the extrusion 166 via conventional fasteners 171 that are received in screw bosses 170 of extrusion 166. A threaded fastener 174 is then used to connect the retainer bracket 169 to the bracket 160. Flange 175 of retainer bracket 169 is offset lower than the upper flange 176, such that extrusion 166 is offset vertically relative to bracket 160, with the lower edge 172 of extrusion 166 forming a gap relative to the surface 173 of bracket 160. The extrusion 166 is thus retained on a first partition frame 2A. To assemble the plan configurations illustrated in FIGS. 34, 35 and 36 brackets 160 are next secured to the required number of partition panel frames 2. The required number of partition panel frames 2 can then be secured to the extrusion 166 that is attached to the first partition frame 2A by lifting the panel edge, and sliding the edges 163 of the bracket 160 downwardly into the opposed slots 168 of channel 167 of extrusion 166. If required for a particular application, a single adjacent panel frame 2A can be assembled to form the L junction 155 of FIG. 34. Alternately, two additional panel frames may be connected to the first panel frame 2A to form the T junction 156 of FIG. 35. Finally, three additional panel frames 2 can be interconnected with the first panel frame 2A to form the X junction 157 illustrated in FIG. 36.

Extrusion 166 is also utilized in conjunction with an upper bracket assembly 180. After the lower bracket assembly 165 is assembled, and the adjacent frames are positioned in the desired configuration, brackets 160 are secured to the first panel frame 2A, and the adjacent panel frames. The extrusion 166 is then slid downwardly into engagement with the brackets 160, and plates 181 are then utilized to interconnect the brackets 160 to the extrusion 166 via conventional threaded fasteners 182 that are received in screw bosses 170, and fasteners 183 that are received in threaded openings 164 of brackets 160.

Figure 37:
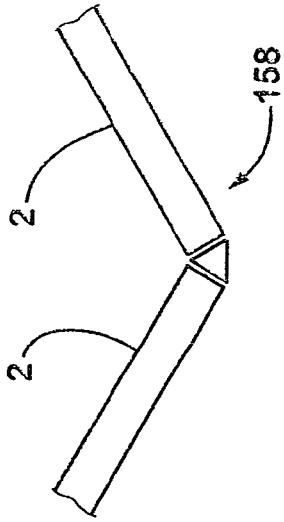
FIG. 37 is a schematic plan view of a pair of panels that are interconnected to form a V junction having a 120° angle between the panels.
Figure 41:
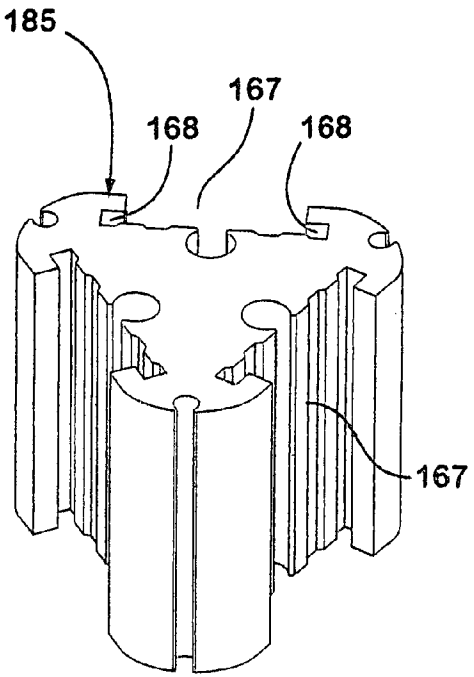
FIG. 41 is a perspective view of a bracket that may be utilized to form the V and Y plan configurations of FIGS. 37 and 38.

With further reference to FIG. 41, an extrusion 185 may be utilized to form the V junction of FIG. 37, and may also be utilized to form the Y junction 159 of FIG. 38. Extrusion 185 includes a plurality of channels 167 that are substantially the same as those of extrusion 166, and the extrusion 185 is utilized to interconnect the adjacent panels in the desired plan configuration in substantially the same manner as described in detail above in connection with extrusion 166.

Figure 46:
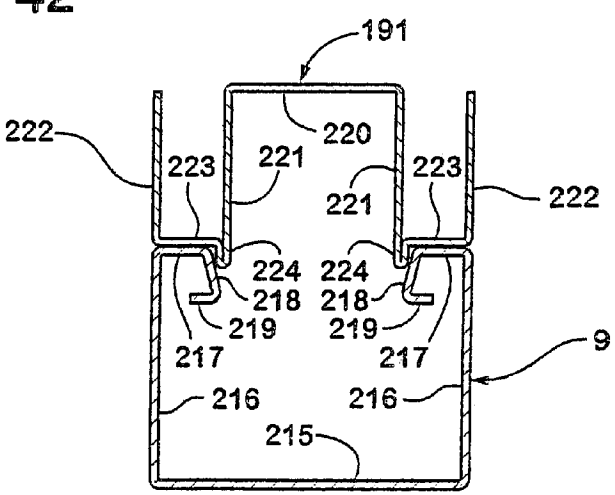
FIG. 46 is a cross-sectional view taken along the line XLVI—XLVI.
Figure 42:
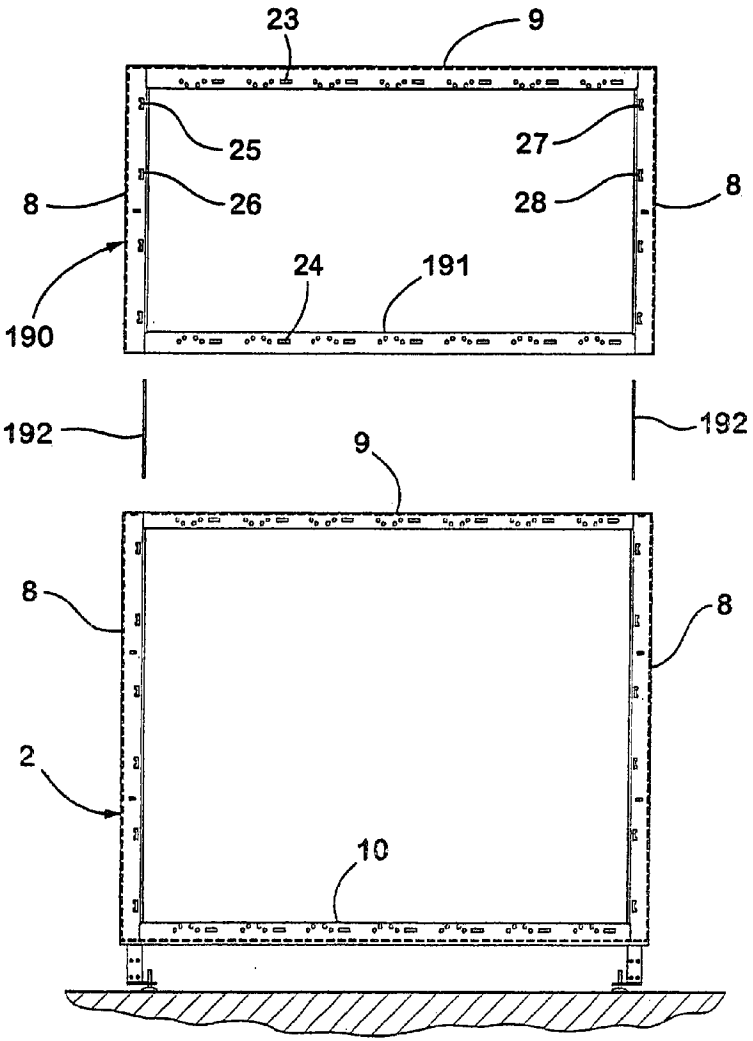
FIG. 42 is an exploded side view of a partition assembly including a base frame and stacker frame.

With further reference to FIG. 42, a stacker frame 190 may be secured to the partition frame 2 to increase the height of the partition panel. Stacker frame 190 includes vertical frame members 8 and a horizontal upper frame member 9 that are substantially identical to the frame members 8 and 9 of the base frame 2. However, as described in more detail below, the lower horizontal cross member 191 of stacker frame 190 is somewhat different than the lower horizontal cross member 10 of the base frame 2. A pair of connectors or bayonets 192 extend into the vertical side frame members 8 of the base frame 2 and stacker frame 190 when assembled to rigidly interconnect the stacker frame 190 and base frame 2. With further reference to FIG. 46, cross member 9 includes a lower horizontal web 215 and vertical side webs 216 forming a generally U-shaped cross section. A horizontal portion 217 extends inwardly from the vertical side webs 216, and an inwardly angled portion 218 extends downwardly from the horizontal portion 217. An edge portion 219 extends horizontally from the angled portion 218. Cross member 191 of the stacker frame 190 includes an upper horizontal web portion 220, vertical inner webs 221, and upwardly extending outer vertical webs 222 that connect to the inner web 221 via horizontal web portions 223. Folded over flange portions 224 project downwardly below the horizontal web portions 223. When assembled as shown in FIG. 46, the horizontal web portions 223 of stacker cross member 191 abut or rest on the horizontal portions 217 of the horizontal cross member 9. The folded over flange portions 224 fit closely against the angled portions 218 of cross member 9 to facilitate side-to-side alignment of the horizontal frame member 191 with the cross member 9.

Figure 43:
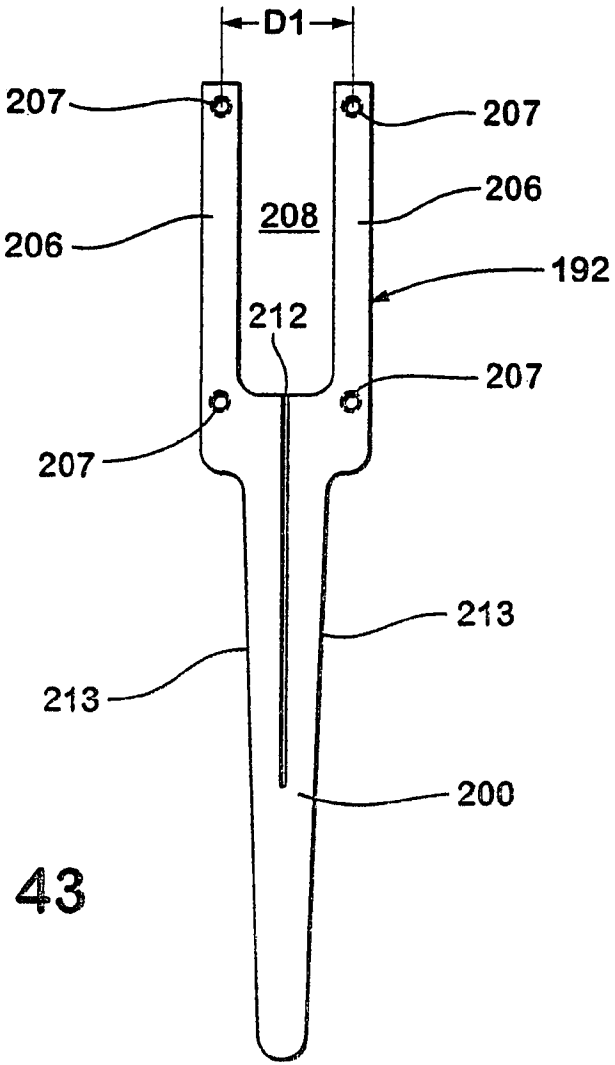
FIG. 43 is a front view of the bayonet of FIG. 43 that connects the stacker frame to the base frame.
Figure 45:
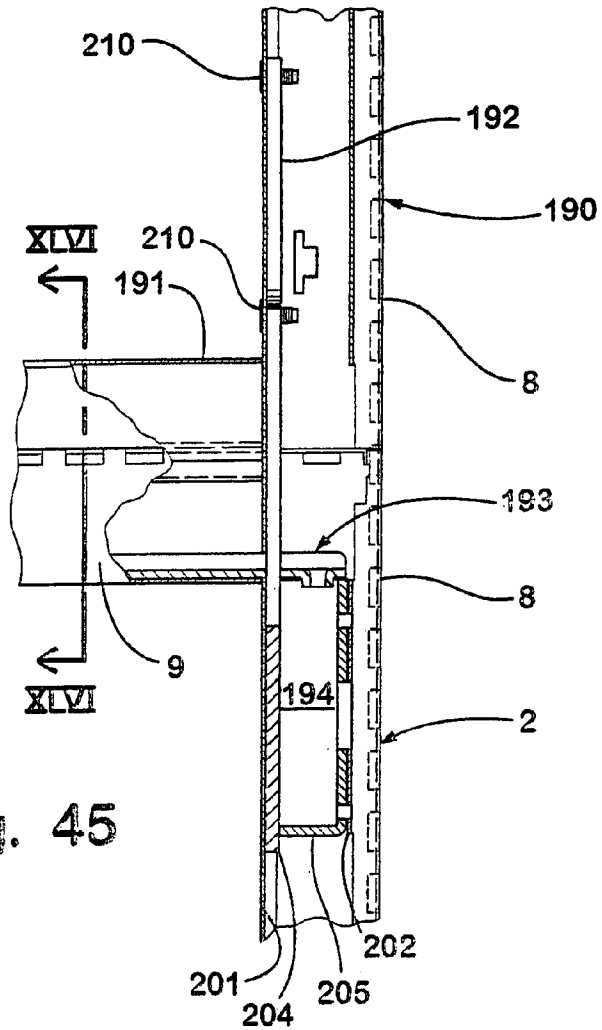
FIG. 45 is a fragmentary cross-sectional view of the stacker frame, base frame, and bayonet.
Figure 44:
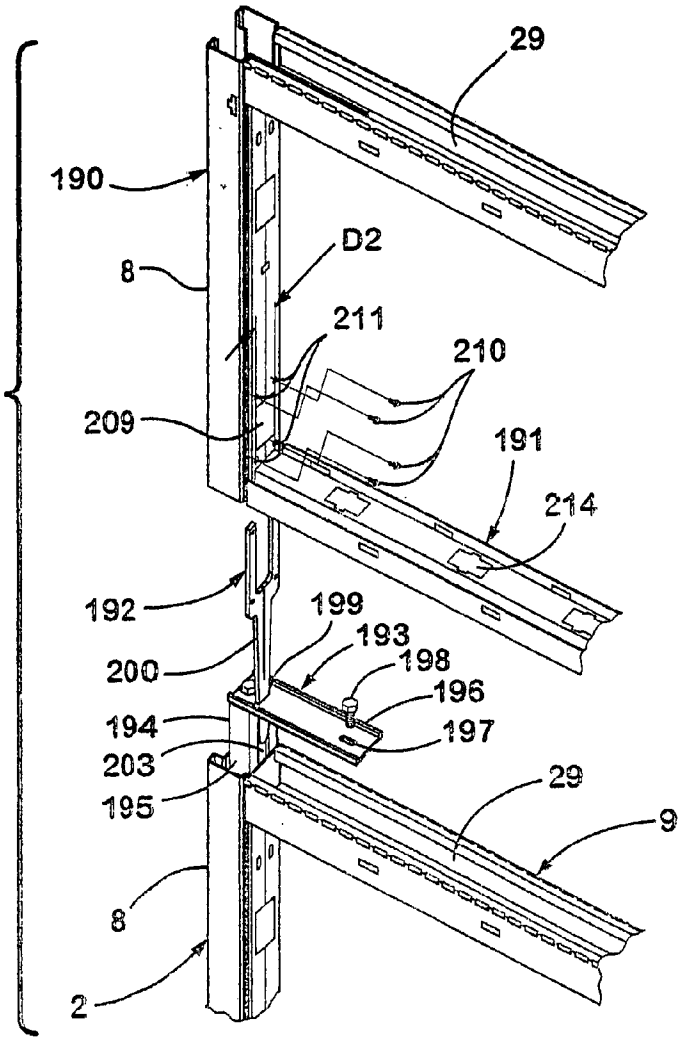
FIG. 44 is a fragmentary, exploded perspective view of the base frame, stacker frame, and bayonet.

With further reference to FIG. 44, a corner bracket 193 includes a vertical portion 194 that is received in the open upper end 195 of the vertical side frame member 8 of base frame 2. Bracket 193 also includes a plate like horizontal portion 196 that fits into the channel 29 when assembled. A threaded fastener 198 is received in an oval opening 197 to secure the bracket 193 to the base frame 2. Alternately, corner bracket 193 could be welded to the base frame 2, or otherwise suitably secured thereto. Bracket 193 includes a rectangular opening 199 through the horizontal portion 196 that receives the elongated lower end 200 (see also FIG. 43) of bayonet bracket 192. With further reference to FIG. 45, the vertical portion 194 of corner bracket 193 fits closely between the inner side walls 201 and 208 of vertical frame member 8 of base frame 2. The elongated lower end 200 of bayonet bracket 192 fits closely within the elongated slot 203 (FIG. 44) in the vertical portion 194 of the corner bracket 193. The slot 203 ensures that the bayonet bracket 192 is maintained in a vertical position. An opening 204 (FIG. 45) in the lower side wall 205 of corner bracket 193 maintains the bayonet bracket 192 in a vertical orientation relative to rotation in the plane of the frames 2 and 190.

With reference to FIG. 43, bayonet bracket 192 includes a pair of upper extensions 206, and a plurality of threaded openings 207. The extensions 206 form a U-shaped open area 208 that aligns with the opening 209 (FIG. 44) in stacker frame 190 to permit pass through of utility lines. A plurality of threaded fasteners 210 extend through the clearance openings 211 in the vertical side frame member of stacker frame 190 and are threadably received in the threaded openings 207 of bayonet bracket 192 when assembled. Bayonet bracket 192 includes an elongated slot 212 that extends a substantial distance into the elongated lower end 200. The distance D1 between the threaded openings 207 in bayonet bracket 192 is somewhat less than the distance D2 (FIG. 44) between the clearance openings 211 in the vertical frame member 8 of stacker frame 190. Threaded fasteners 210 have a conventional conical head, such that as the threaded fasteners 210 are tightened, the conical head contacts the edges of the openings 211. As the threaded fasteners 210 are further tightened, the upper extensions 206 are forced apart slightly, thereby forcing the side edges 213 of elongated lower end 200 of bayonet bracket 192 into tight engagement with the side edges of the rectangular opening 199 in corner bracket 193. Thus, the bayonet bracket 192 rigidly secures the stacker frame 190 to the base frame 2, and also aligns the stacker frame 190 relative to the base frame 2.

Stacker 190 includes an upper channel 29 for horizontal routing of utility lines such as data or communications lines or the like. The lower frame member 191 of stacker frame 190 includes a plurality of openings 214 that align with the openings 58 (see also FIG. 4) in upper horizontal frame member 9 of the base frame 2 to permit vertical routing of wiring between the stacker frame 190 and the base frame 2. Stacker frame 190 also includes a plurality of openings 23, 24, 25, 26, 27 and 28 for mounting of cover panels 7 in substantially the same manner as described above.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A partition for open office space and the like, comprising:

a rigid frame adapted to be supported in a generally vertical orientation along an associated floor surface to partition the open office space into individual workstations, and including:

a first connector disposed on said frame at a predetermined location;

a second connector spaced vertically apart from said first connector;

a third connector spaced horizontally apart from said first and second connectors;

a fourth connector spaced vertically apart from said third connector and horizontally apart from said first and second connectors;

a cover adapted for connection with said frame to cover at least a portion of said frame, and including:

a fifth connector engaging said first connector in a manner which generally prevents both horizontal and vertical movement of said fifth connector relative to said first connector;

a sixth connector spaced vertically apart from said fifth connector, and engaging said second connector in a manner which generally prevents horizontal movement of said sixth connector relative to said second connector, yet permits predetermined vertical movement of said sixth connector relative to said second connector;

a seventh connector spaced horizontally apart from said fifth and sixth connectors, and engaging said third connector in a manner which generally prevents vertical movement of said seventh connector relative to said third connector, yet permits predetermined horizontal movement of said seventh connector relative to said third connector; and an eighth connector spaced vertically apart from said seventh connector and horizontally apart from said fifth and sixth connectors, and engaging said fourth connector in a manner which permits both predetermined horizontal and vertical movement of said eighth connector relative to said fourth connector.

2. A partition as set forth in claim 1, wherein:
said first, second, third and fourth connectors detachably engage said fifth, sixth, seventh and eighth connectors respectively to permit removal and replacement of said cover on said frame.

3. A partition as set forth in claim 2, wherein:
one of said first and fifth connectors comprises a first aperture.

4. A partition as set forth in claim 3, wherein:
one of said first and fifth connectors comprises a first projection shaped for removable insertion into said first aperture for removably securing said cover to said frame.

5. A partition as set forth in claim 4, wherein:
said frame includes first and second side faces on opposite sides thereof;
said cover extends over at least a portion of said first side face; and
said first aperture is disposed on said first side face of said frame.

6. A partition as set forth in claim 5, wherein:
said frame includes first and second uprights extending generally vertically along opposite sides thereof; and
said first aperture is disposed on one of said first and second uprights.

7. A partition as set forth in claim 6, wherein:
said first aperture extends through an adjacent wall of said first upright on said first side face of said frame.

8. A partition as set forth in claim 7, wherein:
said first projection is disposed on said cover and extends rearwardly from a back side of said cover.

9. A partition as set forth in claim 8, wherein:
said second, third and fourth connectors comprise second, third and fourth apertures respectively disposed on said first side face of said frame.

10. A partition as set forth in claim 9, wherein:
said first and second apertures are disposed on said first frame upright; and
said third and fourth apertures are disposed on said second frame upright.

11. A partition as set forth in claim 10, wherein:
said first aperture has a width that is substantially equal to the width of said second aperture.

12. A partition as set forth in claim 11, wherein:
said first aperture has a height that is less than the height of said second aperture.

13. A partition as set forth in claim 12, wherein:
said third aperture has a width that is substantially equal to the width of said fourth aperture.

14. A partition as set forth in claim 13, wherein:
said third aperture has a height that is less than the height of said fourth aperture.

15. A partition as set forth in claim 14, wherein:
said width of said first and second apertures is less than the width of said third and fourth apertures.

16. A partition as set forth in claim 15, wherein:
said height of said first and third apertures is less than the height of said second and fourth apertures.

17. A partition as set forth in claim 16, wherein:
each of said first, second, third and fourth projections has a common projecting configuration.

18. A partition as set forth in claim 17, wherein:
each of said projections with said common projecting configuration has a range of lateral positions when inserted into a respective one of said first, second, third and fourth apertures, and wherein;
said range of lateral positions provided by said first and second apertures is less than said range of lateral positions provided by said third and fourth apertures.

19. A partition as set forth in claim 18, wherein:
each of said projections with said common projecting configuration has a range of vertical positions when inserted into a respective one of said first, second, third and fourth apertures, and wherein;
said range of vertical positions provided by said first and third apertures is less than said range of vertical positions provided by said second and fourth apertures.

20. A partition as set forth in claim 19, wherein:
each of said first, second, third and fourth projections includes a second projecting configuration which differs from said common projecting configuration, and is removably inserted into said first, second, third and fourth apertures respectively.

21. A partition as set forth in claim 20, wherein:
at least one of said first and second apertures has a generally T-shaped front elevational configuration.

22. A partition as set forth in claim 21, wherein:
at least one of said third and fourth apertures has a generally C-shaped front elevational configuration.

23. A partition as set forth in claim 22, wherein:
said cover comprises a panel member having a major planar surface defining an exterior surface of said partition.

24. A partition as set forth in claim 23, wherein:
said panel member has a generally rectangular front elevational shape defined by a top edge, a bottom edge and opposite side edges.

25. A partition as set forth in claim 24, wherein:
said first and second projections are disposed along one of the side edges of said panel member, and said third and fourth projections are disposed along the other one of the side edges of said panel member.

26. A partition as set forth in claim 25, including:
at least two clips extending along the top and bottom edges of said panel member.

27. A partition as set forth in claim 26, wherein:
said frame includes a repositionable horizontal beam attached to said first and second uprights, and having apertures in which said clips are received.

28. A partition as set forth in claim 27, wherein:
said frame includes an upper horizontal frame member rigidly connected with upper ends of said first and second uprights, and having apertures in which said clips are received.

29. A partition as set forth in claim 28, wherein:
said frame includes a lower horizontal frame member rigidly connected with lower ends of said first and second uprights, and having apertures in which said clips are received.

30. A partition as set forth in claim 1, wherein:
one of said first and fifth connectors comprises a first aperture.

31. A partition as set forth in claim 1, wherein:
one of said first and fifth connectors comprises a projection.

32. A partition as set forth in claim 1, wherein:
said frame includes first and second side faces on opposite sides thereof;
said cover extends over at least a portion of said first side face; and
said first, second, third and fourth connectors are disposed on said first side face of said frame.

33. A partition as set forth in claim 1, wherein:

said frame includes first and second uprights extending generally vertically along opposite sides thereof; and said first and second connectors are disposed on said first upright, and said third and fourth connectors are disposed on said second upright.

34. A partition as set forth in claim 1, wherein:

said second, third and fourth connectors comprise second, third and fourth apertures respectively disposed on said first side face of said frame.

35. A partition as set forth in claim 34, wherein:

said first aperture has a width that is substantially equal to the width of said second aperture.

36. A partition as set forth in claim 34, wherein:

said first aperture has a height that is less than the height of said second aperture.

37. A partition as set forth in claim 34, wherein:

said third aperture has a width that is substantially equal to the width of said fourth aperture.

38. A partition as set forth in claim 34, wherein:

said third aperture has a height that is less than the height of said fourth aperture.

39. A partition as set forth in claim 34, wherein:

said first and second apertures have a width that is less than the width of said third and fourth apertures.

40. A partition as set forth in claim 34, wherein:

said first and third apertures have a height that is less than the height of said second and fourth apertures.

41. A partition as set forth in claim 1, wherein:

said first, second, third and fourth connectors comprise first, second, third and fourth apertures respectively; and said fifth, sixth, seventh and eighth connectors comprise projections having a common projecting configuration.

42. A partition as set forth in claim 41, wherein:

each of said projections with said common projecting configuration has a range of lateral positions when inserted into a respective one of said first, second, third and fourth apertures, and wherein;

said range of lateral positions provided by said first and second apertures is less than said range of lateral positions provided by said third and fourth apertures.

43. A partition as set forth in claim 41, wherein:

each of said projections with said common projecting configuration has a range of vertical positions when inserted into a respective one of said first, second, third and fourth apertures, and wherein;

said range of vertical positions provided by said first and third apertures is less than said range of vertical positions provided by said second and fourth apertures.

44. A partition as set forth in claim 1, wherein:

said cover comprises a panel member having a major planar surface defining an exterior surface of said partition.

45. A partition as set forth in claim 44, wherein:

said panel member has a generally rectangular front elevational shape defined by a top edge, a bottom edge and opposite side edges.

46. A partition as set forth in claim 45, wherein:

said fifth and sixth connectors are disposed along one of the side edges of said panel member, and said seventh and eighth connectors are disposed along the other one of the side edges of said panel member.

47. A partition as set forth in claim 45, including:

at least two clips extending along the top and bottom edges of said panel member.

48. A partition as set forth in claim 1, wherein:

said frame includes a repositionable horizontal beam.

49. In a partition system of the type having a plurality of rigid frames interconnected to partition open space into individual areas, and a plurality of cover members detachably mounted on said frames in an edge-to-edge relationship to define narrow gaps between adjacent marginal edges of said cover members, the improvement of a cover mounting arrangement, comprising:

at least one set of frame connectors disposed on each of said frames, comprising:

a first connector disposed on an associated one of said frames at a predetermined location;

a second connector spaced vertically apart from said first connector;

a third connector spaced horizontally apart from said first and second connectors;

a fourth connector spaced vertically apart from said third connector and horizontally apart from said first and second connectors;

at least one set of cover connectors disposed on each of said covers, comprising:

a fifth connector engaging said first connector in a manner which generally prevents both horizontal and vertical movement of said fifth connector relative to said first connector;

a sixth connector spaced vertically apart from said fifth connector, and engaging said second connector in a manner which generally prevents horizontal movement of said sixth connector relative to said second connector, yet permits predetermined vertical movement of said sixth connector relative to said second connector;

a seventh connector spaced horizontally apart from said fifth and sixth connectors, and engaging said third connector in a manner which generally prevents vertical movement of said seventh connector relative to said third connector, yet permits predetermined horizontal movement of said seventh connector relative to said third connector; and an eighth connector spaced vertically apart from said seventh connector and horizontally apart from said fifth and sixth connectors, and engaging said fourth connector in a manner which permits both predetermined horizontal and vertical movement of said eighth connector relative to said fourth connector, whereby said narrow gaps between said adjacent marginal edges of said cover members maintain a substantially uniform width for improved aesthetics.

50. A partition system as set forth in claim 49, wherein:

said panel frames include hanger slots disposed along said narrow gaps between said adjacent marginal edges of said cover member to facilitate mounting accessories on said partition system.

51. A partition system as set forth in claim 50, wherein:

said first, second, third and fourth connectors detachably engage said fifth, sixth, seventh and eighth connectors respectively to permit removal and replacement of said covers on said frames.

52. A partition system as set forth in claim 51, wherein:

said frame includes first and second side faces on opposite sides thereof;

said cover extends over at least a portion of said first side face; and said first, second, third and fourth connectors are disposed on said first side face of said frame.

53. A partition system as set forth in claim 52, wherein:
said first, second, third and fourth connectors comprise first, second, third and fourth apertures respectively disposed on said first side face of said frame.

54. A partition system as set forth in claim 53, wherein:
said fifth, sixth, seventh and eighth connectors comprise first, second, third and fourth projections extending rearwardly from a back side of said cover.

55. A partition system as set forth in claim 54, wherein:
said first aperture has a width that is substantially equal to the width of said second aperture.

56. A partition system as set forth in claim 55, wherein:
said first aperture has a height that is less than the height of said second aperture.

57. A partition system as set forth in claim 56, wherein:
said third aperture has a width that is substantially equal to the width of said fourth aperture.

58. A partition system as set forth in claim 57, wherein:
said third aperture has a height that is less than the height of said fourth aperture.

59. A partition system as set forth in claim 58, wherein:
said width of said first and second apertures is less than the width of said third and fourth apertures.

60. A partition system as set forth in claim 59, wherein:
said height of said first and third apertures is less than the height of said second and fourth apertures.

61. A partition system as set forth in claim 60, wherein:
each of said first, second, third and fourth projections has a common projecting configuration.

62. A partition system as set forth in claim 61, wherein:
each of said projections with said common projecting configuration has a range of lateral positions when inserted into a respective one of said first, second, third and fourth apertures, and wherein;
said range of lateral positions provided by said first and second apertures is less than said range of lateral positions provided by said third and fourth apertures.

63. A partition system as set forth in claim 62, wherein:
each of said projections with said common projecting configuration has a range of vertical positions when inserted into a respective one of said first, second, third and fourth apertures, and wherein;
said range of vertical positions provided by said first and third apertures is less than said range of vertical positions provided by said second and fourth apertures.

64. A partition system as set forth in claim 63, wherein:
each of said first, second, third and fourth projections includes a second projecting configuration which differs from said common projecting configuration, and is removably inserted into said first, second, third and fourth apertures respectively.

65. A partition system as set forth in claim 64, wherein:
said frame includes a repositionable horizontal beam.

66. In a partition of the type having at least one rigid frame adapted to be supported in a generally vertical orientation along an associated floor surface to partition open space, and at least one cover detachably mounted on said frame to selectively cover at least a portion thereof, the improvement of a cover mounting arrangement, comprising:
a first connector disposed on said frame at a predetermined location;
a second connector disposed on said frame, and spaced vertically apart from said first connector;
a third connector disposed on said frame, and spaced horizontally apart from said first and second connectors;
a fourth connector disposed on said cover, and detachably engaging said first connector in a manner which generally prevents both horizontal and vertical movement of said fourth connector relative to said first connector;
a fifth connector disposed on said cover, spaced vertically apart from said fifth connector, and detachably engaging said second connector in a manner which generally prevents horizontal movement of said fifth connector relative to said second connector, yet permits predetermined vertical movement of said fifth connector relative to said second connector;
a sixth connector disposed on said cover, spaced horizontally apart from said fourth and fifth connectors, and detachably engaging said third connector in a manner which generally prevents vertical movement of said sixth connector relative to said third connector, yet permits predetermined horizontal movement of said sixth connector relative to said third connector.

67. A partition as set forth in claim 66, wherein:
one of said first and fourth connectors comprises a first aperture.

68. A partition as set forth in claim 67, wherein:
one of said first and fourth connectors comprises a first projection shaped for removable insertion into said first aperture for removably securing said cover to said frame.

69. A partition as set forth in claim 68, wherein:
said frame includes first and second side faces on opposite sides thereof;
said cover extends over at least a portion of said first side face; and
said first aperture is disposed on said first side face of said frame.

70. A partition as set forth in claim 69, wherein:
said first projection is disposed on said cover and extends rearwardly from a back side of said cover.

71. A partition as set forth in claim 70, wherein:
said second and third connectors comprise second and third apertures respectively disposed on said first side face of said frame.

72. A partition as set forth in claim 71, wherein:
said fifth and sixth connectors comprise second and third projections respectively disposed on the back side of said cover.

73. A partition as set forth in claim 71, wherein:
said first aperture has a width that is substantially equal to the width of said second aperture.

74. A partition as set forth in claim 73, wherein:
said first aperture has a height that is less than the height of said second aperture.

75. A partition as set forth in claim 74, wherein:
said width of said first and second apertures is less than the width of said third aperture.

76. A partition as set forth in claim 75, wherein:
said first and third apertures have a height that is less than the height of said second aperture.

77. A partition as set forth in claim 76, wherein:
each of said first, second and third projections has a common projecting configuration.

78. A partition as set forth in claim 77, wherein:
each of said projections with said common projecting configuration has a range of lateral positions when inserted into a respective one of said first, second and third apertures, and wherein;
said range of lateral positions provided by said first and second apertures is less than said range of lateral positions provided by said third aperture.

79. A partition as set forth in claim 78, wherein:

each of said projections with said common projecting configuration has a range of vertical positions when inserted into a respective one of said first, second and third apertures, and wherein;

said range of vertical positions provided by said first and third apertures is less than said range of vertical positions provided by said second aperture.

80. A partition as set forth in claim 79, wherein:

each of said first, second and third projections includes a second projecting configuration which differs from said common projecting configuration, and is removably inserted into said first, second and third apertures respectively.

81. A partition as set forth in claim 80, wherein:

at least one of said first and second apertures has a generally T-shaped front elevational configuration.

82. A partition as set forth in claim 81, wherein:

said aperture has a generally C-shaped front elevational configuration.

83. A partition as set forth in claim 82, wherein:

said frame includes a repositionable horizontal beam.

84. In a reconfigurable partition system having a plurality of individual panels with opposite sides thereof detachably interconnected in a predetermined configuration to define at least one workstation, the improvement of a panel-to-panel connector, comprising:

a generally T-shaped opening disposed in the side of a first one of said panels, and including an enlarged upper portion thereof having a predetermined width, and a narrower lower portion thereof communicating with said upper portion, and having a width less than the width of said upper portion;

a bracket having a flange portion thereof connected with the side of a second one of said panels, and a generally T-shaped tongue portion thereof extending laterally outwardly from said flange portion, and including an enlarged head shaped for reception through the upper portion of said opening, and a narrower root shaped for close reception in the lower portion of said opening to selectively capture said head within the lower portion of said opening; said tongue portion being shaped to position said head a predetermined vertically spaced apart distance from said opening in said first panel when said first and second panels are disposed in a horizontally aligned, side-by-side position, such that said first and second panels must be mutually shifted to a non-aligned position to insert the head of said bracket into said opening, and having a predetermined length measured between said root and said flange, whereby shifting said first and second panels back to said horizontally aligned side-by-side position tenses said bracket and draws the sides of said first and second panels closely together.

85. A partition system as set forth in claim 84, wherein:

said tongue portion of said bracket is flexible.

86. A partition system as set forth in claim 85, wherein:

said tongue portion of said bracket is resiliently flexible, and elastically deforms when said first and second panels are in said horizontally aligned side-by-side position to bias the sides of said first and second panels together.

87. A partition system as set forth in claim 86, wherein:

said tongue portion of said bracket is closely received in said opening to horizontally align said first and second panels.

88. A partition system as set forth in claim 87, wherein:

said sides of said panels each have an upper portion and a lower portion when said first and second panels are oriented in a generally upright position;

said opening is disposed adjacent the lower portion of said first panel; and said bracket is disposed adjacent the lower portion of said second panel, and defines a lower bracket.

89. A partition system as set forth in claim 88, including:

an upper bracket detachably connecting the upper portion of said first panel with the upper portion of said second panel.

90. A partition system as set forth in claim 89, wherein:

said upper bracket comprises a plate having vertically oriented fastener apertures extending through opposite ends thereof.

91. A partition system as set forth in claim 90, wherein:

said first and second panels each have an upper surface with a vertically oriented fastener receiving opening therein adjacent the associated side; and including fasteners extending through said fastener apertures in said plate and into the fastener openings in the upper surfaces of said first and second panels.

92. A partition system as set forth in claim 91, wherein:

said fastener apertures in said plate are spaced apart a first distance; and said fastener openings in the upper surfaces of said first and second panels are spaced apart a second distance, which is greater than said first distance, such that tightening said fasteners draws the upper portions of said first and second panels closely together.

93. A partition system as set forth in claim 84, wherein:

said sides of said panels each have an upper portion and a lower portion when said first and second panels are oriented in a generally upright position;

said opening is disposed adjacent the lower portion of said first panel;

said bracket is disposed adjacent the lower portion of said second panel, and defines a lower bracket; and including an upper bracket detachably connecting the upper portion of said first panel with the upper portion of said second panel, comprising a plate having vertically oriented fastener apertures extending through opposite ends thereof, and fasteners extending through said fastener apertures in said plate and into fastener openings in upper surfaces of said first and second panels.

94. A partition for open office spaces, comprising:

a freestanding base panel adapted to be supported on an associated floor surface, and including an upper edge with at least one vertically extending mounting aperture therein, and an upwardly opening, horizontally extending utility channel configured to receive and retain lay-in utilities therein;

a stacker panel adapted to be detachably supported on said upper edge of said base panel in a vertically stacked relationship to selectively increase the overall height of said partition, and including a lower edge with at least one vertically extending mounting aperture therein positioned in vertical alignment with said mounting aperture in said upper edge of said base panel; and at least one bayonet connector detachably interconnecting said base panel and said stacker panel in said vertically stacked relationship, and having a generally Y-shaped front elevational configuration defined by a lower shank portion thereof and a pair of upper extension portions thereof forming a U-shaped open area therebetween; said shank portion being telescopingly received in said vertically extending mounting aperture in said base panel, and said upper extension portions being telescopingly received in said vertically extending mounting aperture in said stacker panel, such that said U-shaped open area aligns with said utility channel in said upper edge of said base panel to permit utilities to be routed horizontally through said partition.

95. A partition as set forth in claim 94, wherein:

said bayonet connector is generally flat; and said vertically extending mounting apertures in said base panel and said stacker panel comprise elongate slots in which said bayonet connector is closely received.

96. A partition as set forth in claim 95, wherein:

said bayonet connector includes an elongate slot extending from said open area between said upper extension portions to a predetermined location along said shank portion.

97. A partition as set forth in claim 96, including:

fasteners positively securing said upper extension portions of said bayonet connector with said stacker panel.

98. A partition as set forth in claim 97, wherein:

said fasteners are arranged to diverge said upper extension portions of said bayonet connector when tightened to securely engage said bayonet connector in said elongate slots in said base panel and said stacker panel.

* * * * *